US006177227B1

(12) United States Patent
Nakagawa

(10) Patent No.: US 6,177,227 B1
(45) Date of Patent: Jan. 23, 2001

(54) HEAT-DEVELOPMENT COLOR PHOTOGRAPHIC LIGHT SENSITIVE MATERIAL

(75) Inventor: Hajime Nakagawa, Minami-ashigara (JP)

(73) Assignee: Fuji Photo film Co., Ltd., Kanagawa-ken (JP)

( * ) Notice: Under 35 U.S.C. 154(b), the term of this patent shall be extended for 0 days.

(21) Appl. No.: 09/366,652

(22) Filed: Aug. 4, 1999

(30) Foreign Application Priority Data

Aug. 4, 1998 (JP) ..... 10-231114

(51) Int. Cl.[7] ..... G03C 8/20; G03C 8/40; G03C 8/22; G03C 1/42

(52) U.S. Cl. ..... 430/203; 430/214; 430/218; 430/559

(58) Field of Search ..... 430/203, 214, 430/218, 559

(56) References Cited

U.S. PATENT DOCUMENTS 4,021,240 * 5/1977 Cerquone et al. ..... 430/218
4,360,581 * 11/1982 Odenwalder et al. ..... 430/218
4,483,914 * 11/1984 Naito et al. ..... 430/203
4,584,263 * 4/1986 Takahashi ..... 430/218
4,782,004 * 11/1988 Takeuchi et al. ..... 430/214
5,236,803 8/1993 Ono et al. ..... 430/214
5,698,365 * 12/1997 Taguchi et al. ..... 430/203

* cited by examiner

*Primary Examiner*—Richard L. Schilling
(74) *Attorney, Agent, or Firm*—Birch, Stewart, Kolasch & Birch LLP

(57) ABSTRACT

There is disclosed a heat-development color photographic light-sensitive material which has on a base at least two applied silver halide emulsion layers different in color sensitivity from each other and at least one applied non-light-sensitive layer, wherein the silver halide emulsion layer or the non-light-sensitive layer contains a dye providing compound and at least one specific diffusible electron transport agent, and wherein the non-light-sensitive layer contains a compound capable of reacting with an oxidized product of the electron transport agent. The light-sensitive material can provide an image excellent in discrimination even by subjecting to development for a short period of time, and is excellent in color separation.

18 Claims, No Drawings

HEAT-DEVELOPMENT COLOR PHOTOGRAPHIC LIGHT SENSITIVE MATERIAL

FIELD OF THE INVENTION

The present invention relates to a silver halide color light-sensitive material. More particularly, the present invention relates to a heat-development silver halide color photographic light-sensitive material that can form an excellent image even by subjecting to development for a short period of time, and that is excellent in color reproduction.

BACKGROUND OF THE INVENTION

The method wherein a diffusion dye is released or formed imagewise by heat development and the resultant diffusion dye is transferred to a dye-fixing element is practically used. In this method, by changing the type of the dye-providing compound to be used or the type of the silver halide to be used, a negative dye image, as well as a positive dye image, can be obtained. More details are described in U.S. Pat. No. 4,500,626, U.S. Pat. No. 4 483 914, U.S. Pat. No. 4 503 137, U.S. Pat. No. 4 559 290, JP-A-58-149049 ("JP-A" means unexamined published Japanese patent application), JP-A-60-133449, JP-A-59-218443, JP-A-61-238056, EP-A-210 660 (A2), and the like.

With respect to the method for obtaining, particularly, a positive color image by heat development, various methods are proposed. For example, U.S. Pat. No. 4,559,290 describes a method wherein a so-called DRR compound (a diffusion-dye releasing-type redox compound) is used, which has been formed into an oxidized compound incapable of releasing a dye image. In this method, a reducing agent is oxidized in proportion to the exposure amount of a silver halide by heat development, and the above oxidized compound is reduced with the unoxidized remaining reducing agent, to cause a diffusion dye to be released, to form a positive color image. Further, U.S. Pat. No. 4,783,396 and the Journal of Technical Disclosure ("Kokai Giho") No. 87-6199 (Vol. 12, No. 22) describe heat-development color light-sensitive materials wherein use is made, as a compound capable of releasing a diffusion dye by the same mechanism, of a compound capable of releasing a diffusion dye by cleavage of the N-X bond, in which X represents for an oxygen atom, a nitrogen atom, or a sulfur atom, in a reducing fashion.

Moreover, as described, for example, in the October edition of "Eizo Joho" (issued on Oct. 1, 1993), edited by Ken Kuniyone and published by Sangyo Kaihatsu Kiko KK, recently the progress of computer graphics and the like is remarkable, and high-image-quality color printers (color hard copies) of various systems for outputting the image information thereof are developed. Among them, printers wherein heat-development color light-sensitive materials using silver halides are used, such as "FUJIX PICTOGRAPHY 3000" or "PICTROSTAT DIGITAL 400", trade names, manufactured by Fuji Photo Film Co., Ltd., are sold or made public.

Since these apparatuses carry out negative-positive conversion in a digital fashion, as the light-sensitive materials used therein, a conventional DRR compound can be used as it is, and the discrimination is excellent.

By using these light-sensitive materials, a high-quality dye image can be obtained in a short period of time. However, in recent years, it is desired to quicken the process further in the market. To shorten the processing time further, it is conceived to carry out the process at a higher temperature, but control of the period of the process under such a condition becomes difficult, leading to unevenness of the image or the like, sometimes.

On the other hand, the technique for accelerating development by addition of a reducing agent, such as phenidone, as an electron transport agent (an electron transferring agent), has long been known. Nevertheless, when the existing reducing agent is used, harmful effects occur, such as deterioration of the stability of light-sensitive materials, an increase in the density of the white background, and lowering in color separation.

SUMMARY OF THE INVENTION

Accordingly, an object of the present invention is to provide a silver halide color photographic light-sensitive material that can provide an image excellent in discrimination even by subjecting to development for a short period of time, and that is excellent in color separation.

Other and further objects, features, and advantages of the invention will appear more fully from the following description.

DETAILED DESCRIPTION OF THE INVENTION

The object of the present invention is attained by the following light-sensitive materials and dye-forming method:

(1) A heat-development color photographic light-sensitive material having on a base at least two applied silver halide emulsion layers different in color sensitivity from each other and at least one applied non-light-sensitive layer, wherein the silver halide emulsion layer or the non-light-sensitive layer contains a dye providing compound and at least one diffusible electron transport agent represented by formula (1) or (2):

formula (1)

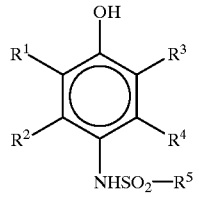

formula (2)

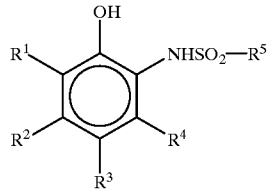

wherein $R^1$, $R^2$, $R^3$, and $R^4$ each represent a hydrogen atom, a halogen atom, a cyano group, or an alkyl group, an aryl group, a heterocyclic group, an alkoxy group, an aryloxy group, an alkylthio group, an arylthio group, an alkylcarbonyl group, an arylcarbonyl group, an alkylsulfonyl group, an arylsulfonyl group, an alkylcarbonamido group, an arylcarbonamido group, an alkylsulfonamido group, an arylsulfonamido group, an alkylcarbonyloxy group, an arylcarbonyloxy group, a carbamoyl group, an alkylcarbamoyl group, an arylcarbamoyl group, an alkoxycarbonyl group, an aryloxycarbonyl group, a sulfamoyl group, an alkylsulfamoyl group, an arylsulfamoyl group, a ureido group, or a urethane group that respectively has 4 or less carbon atoms or an I/O value of 1 or more, and $R^5$ represents an alkyl group, an aryl group, a heterocyclic group, an alkylamino group, an arylamino group, or a heterocyclic amino group, and wherein the non-light-sensitive layer contains a compound capable of reacting with an oxidized product of the electron transport agent;

(2) The heat-development color photographic light-sensitive material as stated in the above (1), wherein the compound capable of reacting with the oxidized product of the electron transport agent is a compound represented by the following formula (A):

formula (A)

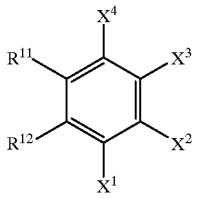

wherein $R^{11}$ and $R^{12}$ each represent a hydrogen atom, a halogen atom, a carboxyl group or a sulfo group that may be in the form of a salt, or a substituted or unsubstituted alkyl group, aryl group, acylamino group, alkoxy group, aryloxy group, alkylthio group, arylthio group, carbamoylamino group, alkoxycarbonylamino group, aryloxycarbonylamino group, carbamoyl group, acyl group, alkoxycarbonyl group, aryloxycarbonyl group, sulfamoyl group, or sulfonyl group, one of $X^1$, $X^2$, $X^3$, and $X^4$ represents a hydroxyl group, at least one of the rest thereof represents a hydroxyl group, a sulfonamido group, or a carbonamido group, and others of the rest thereof each represent one of the above-mentioned atoms or groups represented by $R^{11}$, and $R^{12}$, and the total number of carbon atoms of $R^{11}$, $R^{12}$, $X^1$, $X^2$, $X^3$, and $X^4$ is 10 or more;

(3) The heat-development color photographic light-sensitive material as stated in the above (1), wherein the compound capable of reacting with the oxidized product of the electron transport agent is a coupler capable of forming a non-diffusion dye, or a non-dye-forming coupler (a so-called colorless coupler);

(4) The heat-development color photographic light-sensitive material as stated in any one of the above (1) to (3), wherein the compound capable of reacting with the oxidized product of the electron transport agent is a non-diffusion compound; and (5) An image-forming method, comprising subjecting the silver halide color photographic light-sensitive material as stated in the above (1) to heat development, to release or form a diffusion dye imagewise, and transferring the diffusion dye to a dye fixing element.

Now, the compounds represented by formula (1) or (2) are described in detail.

The compounds represented by formula (1) or (2) are called sulfonamidophenols collectively and are substantially colorless reducing agents. When the oxidized product of this compound is permitted to undergo a coupling reaction with a coupler, the coupler can be used as the compound contained in the non-light-sensitive layer. Because of the possession of $R^1$ to $R^5$ specified in these formulas, the compound can move substantially in the layers of the light-sensitive material and this results in excellent color-forming property even by processing for a fairly short period of time. In the formulas, particularly preferably $R^5$ is an aryl group represented by the following formula (3):

formula (3)

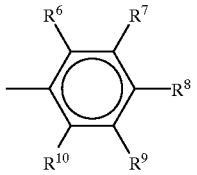

In formula (3), $R^6$, $R^7$, $R^8$, $R^9$, and $R^{10}$ each represent a hydrogen atom, a halogen atom, a cyano group, a nitro group, or an alkyl group, a heterocyclic group, an alkoxy group, an aryloxy group, an alkylthio group, an arylthio group, an alkylcarbonyl group, an arylcarbonyl group, an alkylsulfonyl group, an arylsulfonyl group, an alkylcarbonamido group, an arylcarbonamido group, an alkylsulfonamido group, an arylsulfonamido group, an alkylcarbonyloxy group, an arylcarbonyloxy group, a carbamoyl group, an alkylcarbamoyl group, an arylcarbamoyl group, an alkoxycarbonyl group, an aryloxycarbonyl group, a sulfamoyl group, an alkylsulfamoyl group, an arylsulfamoyl group, a ureido group, or a urethane group that respectively has 4 or less carbon atoms or an I/O value of 1 or more; and $R^6$ and $R^7$, $R^7$ and $R^8$, $R^8$ and $R^9$, and $R^9$ and $R^{10}$ each may independently form a ring.

In $R^1$ to $R^4$, and $R^6$ to $R^{10}$, the term I/O value means a parameter representing the scale of the lipophilicity and the hydrophilicity of a compound or a substituent, and it is described in detail in "Yuki Gainen-zu" (written by Koda Yoshiki; published by Sankyo Shuppan, May 10, 1984). "I" denotes inorganic nature, and "O" denotes organic nature. The larger the I/O value is, the higher the inorganic nature is. The I/O value is preferable 1.1 or more. Here, specific examples of I/O values are described. The O value is 20 per carbon atom. Representative examples of the I value are 200 for an —NHCO— group, 240 for an —$NHSO_2$— group, and 60 for a —COO— group. For instance, in the case of —$NHCOC_5H_{11}$, the number of carbon atoms is 6, the O value is 20×6=120, and I=200, so that I/O 1.67, and therefore I/O >1.

Out of the compounds represented by formula (1) or (2), those compounds are preferable wherein the positions of $R^1$ to $R^4$ or $R^6$ to $R^{10}$ have a halogen atom, a cyano atom, or a substituent having an I/O value of 1 or more or 4 or less carbon atoms. These compounds are characterized by hydrophilic nature.

Specific examples of the $R^1$ to $R^4$ or $R^6$ to $R^{10}$ include, for example, a hydrogen atom, a halogen atom (e.g. chlorine and bromine), a cyano group, a nitro group (for $R^6$ to $R^{10}$), an alkyl group (e.g. methyl, ethyl, isopropyl, n-butyl, and t-butyl), an aryl group (e.g. 3-methanesulfonylaminophenyl), a heterocyclic group (e.g. 2-imidazolyl group), an alkoxy group (e.g. methoxy and ethoxy), an aryloxy group (e.g. 4-methanesulfonylaminophenoxy), an alkylthio group (e.g. methylthio, ethylthio, and butylthio), an arylthio group (e.g. 4-methanesulfonylaminophenylthio), an alkylcarbonyl group (e.g. acetyl, propionyl, and butyloyl), an arylcarbonyl group (e.g. benzoyl and alkylbenzoyl), an alkylsulfonyl group (e.g. methanesulfonyl and ethanesulfonyl), an arylsulfonyl group (e.g. phenylsulfonyl, 4-chlorophenylsulfonyl, and p-toluenesulfonyl), an alkylcarbonamido group (e.g. acetylamino, propionylamino, and butyroylamino), an arylcarbonamido group (e.g. benzoylamino), an alkylsulfonamido group (e.g. methanesulfonylamino and ethanesulfonylamino), an arylsulfonamido group (e.g. benzenesulfonylamino and toluenesulfonylamino), an alkylcarbonyloxy group (e.g. methylcarbonyloxy, propylcarbonyloxy, and butylcarbonyloxy), an arylcarbonyloxy group (e.g. 4-methanslfonylaminobenzoyloxy), a carbamoyl group, an alkylcarbamoyl group (e.g. methylcarbamoyl, dimethylcarbamoyl, ethylcarbamoyl, diethylcarbamoyl, dibutylcarbamoyl, piperidinocarbamoyl, and morpholinocarbamoyl), an arylcarbamoyl group (e.g. phenylcarbamoyl, methylphenylcarbamoyl, ethylphenylcarbamoyl, and benzylphenylcarbamoyl), an alkoxycarbonyl group (e.g. methoxycarbonyl, ethoxycarbonyl, and butoxycarbonyl), an aryloxycarbonyl group (e.g. phenoxycarbonyl), a sulfamoyl group, an alkylsulfamoyl group (e.g. methylsulfamoyl, dimethylsulfamoyl, ethylsulfamoyl, diethylsulfamoyl, dibutylsulfamoyl, piperidinosulfamoyl, and morpholinosulfamoyl), an arylsulfamoyl group (e.g. phenylsulfamoyl, methylphenylsulfamoyl, ethylphenylsulfamoyl, and benzylphenylsulfamoyl), a ureido group (e.g., methylaminocarbonamide, anilinocarbonamide), or a urethane group (e.g., methoxycarbonamido, anilinocarbonyloxy).

Particularly, in formula (1), preferably $R^2$ and/or $R^4$, and $R^6$ and/or $R^{10}$ represent a substituent other than a hydrogen atom, and in formula (2), $R^4$, and $R^6$ and/or $R^{10}$ represent a substituent other than a hydrogen atom. Further, when $R^1$ and $R^2$, $R^3$ and $R^4$, $R^6$ and $R^7$, $R^7$ and $R^8$, $R^8$ and $R^9$, and $R^9$ and $R^{10}$ are each a substituent other than a hydrogen atom, they may independently bond together to form a ring, with keeping the condition that the I/O value is 1 or more in the combination of the substituents.

Further in the regard of the effects of the invention, the compound of formula (1) is better.

The compounds represented by formula (1) or (2) can be synthesized by a stepwise combination of methods widely known in the field of organic synthetic chemistry. Examples of the synthesis thereof are shown below as synthetic schemes:

Synthesis Route of Exemplified Compounds

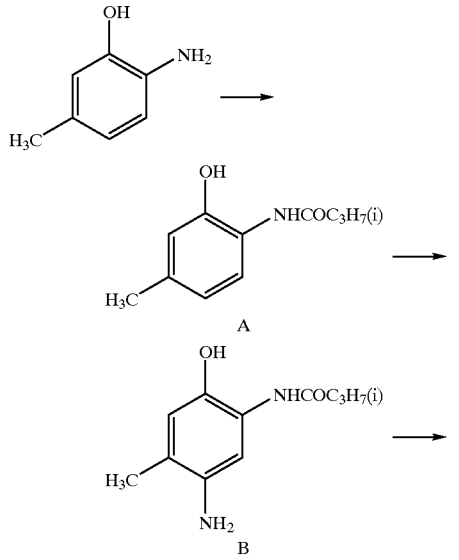

-continued

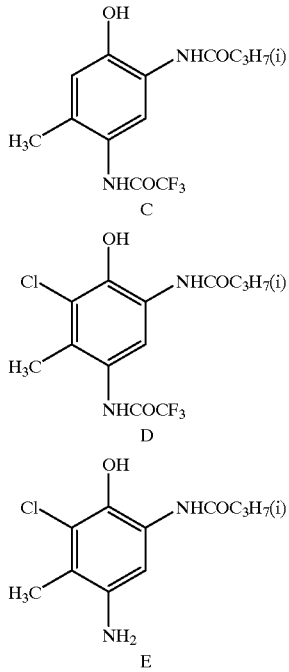

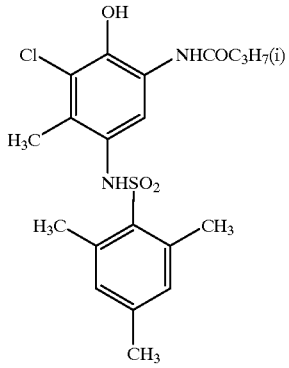

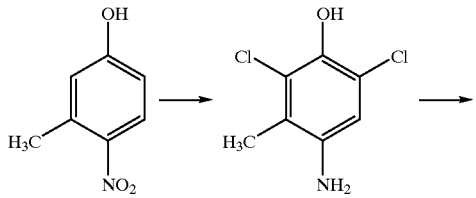

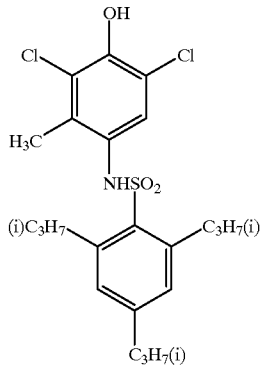

Hereinbelow, specific examples of the compounds represented by formula (1) or (2) are shown below, but they do not mean that the compounds of formula (1) or (2) for use in the present invention are limited to those.
(D-1)
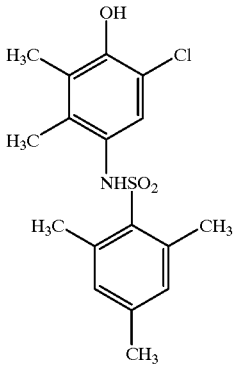
(D-2)
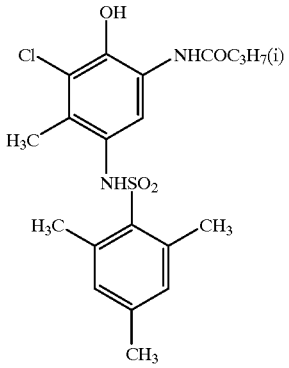
(D-3)
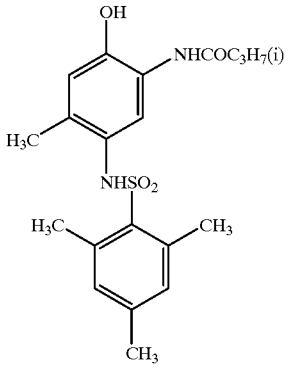
(D-4)
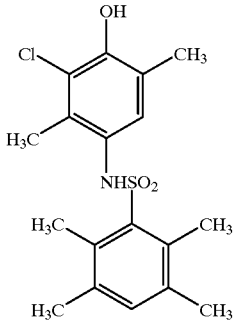
-continued
(D-5)
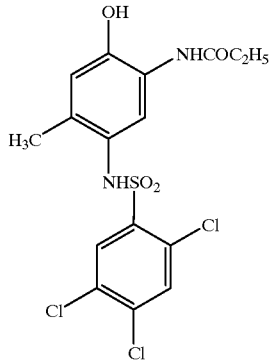
(D-6)
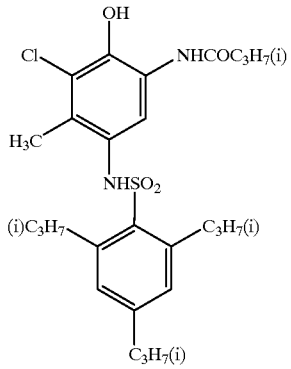
(D-7)
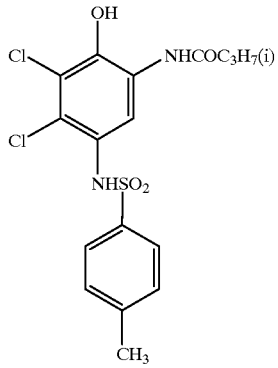
(D-8)
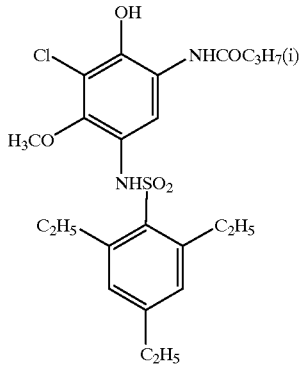

-continued
(D-9)
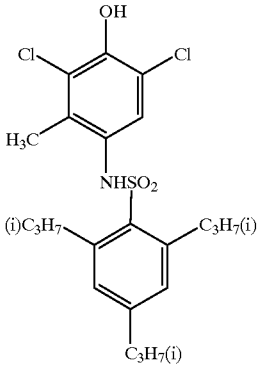
(D-10)
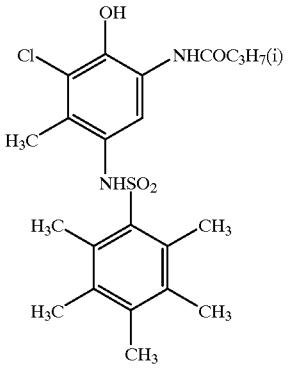
(D-11)
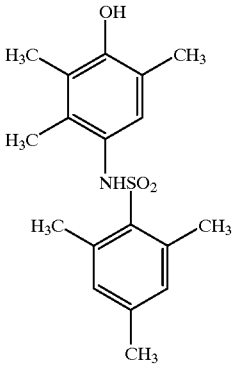
(D-12)
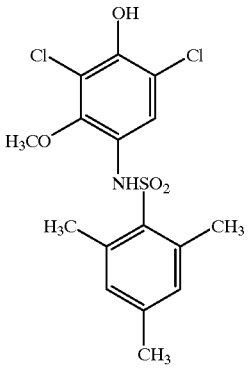
-continued
(D-13)
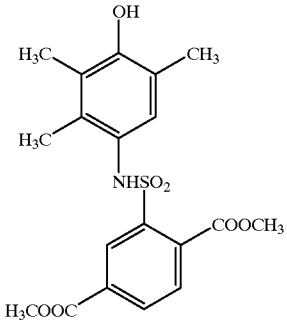
(D-14)
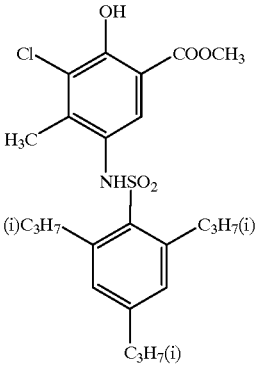
(D-15)
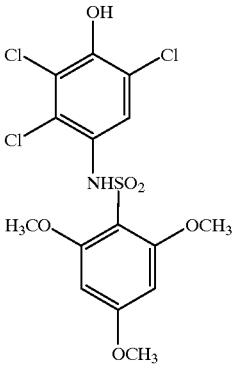
(D-16)
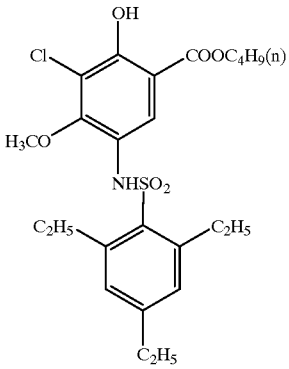

-continued
(D-17)
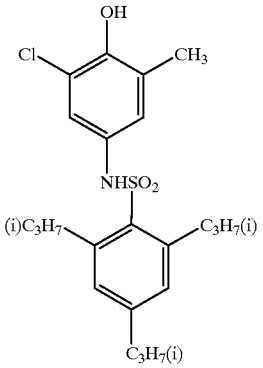
(D-18)
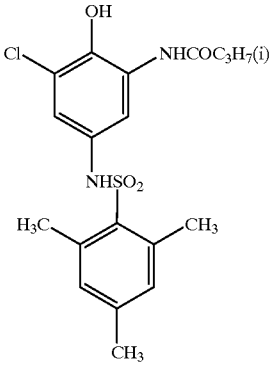
(D-19)
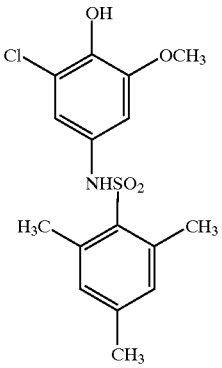
(D-20)
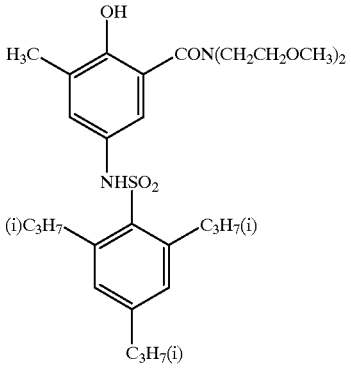
-continued
(D-21)
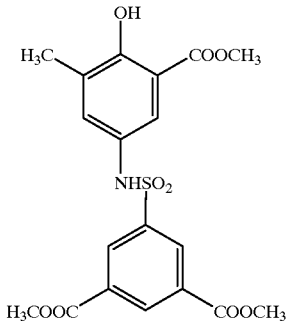
(D-22)
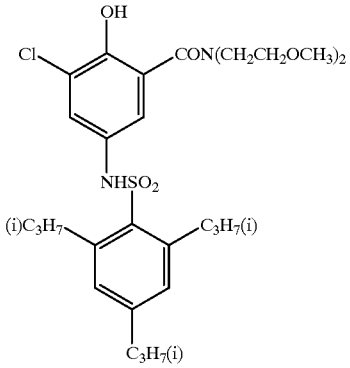
(D-23)
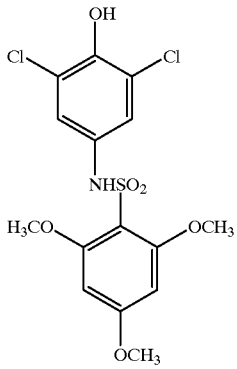
(D-24)
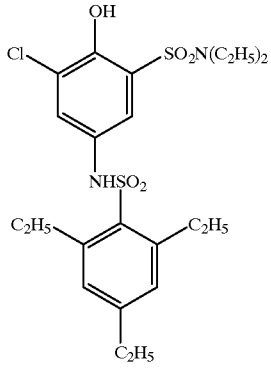
The amount of the compound represented by formula (1) or (2) to be used in the present invention is preferably in the range of 0.01 mol % to 2 mol %, more preferably in the range of 0.05 mol % to 1 mol %, and most preferably in the range of 0.05 mol % to 0.5 mol %, to the dye providing compound.

The compound represented by formula (1) or (2) for use in the present invention can be used in any hydrophilic layer in the light-sensitive material. Namely, it can be used in a light-sensitive silver halide emulsion layer and/or a non-light-sensitive layer. When this compound capable of reacting with the oxidized product of the electron transport agent is contained in a non-light-sensitive layer, this non-light-sensitive layer may be the same non-light-sensitive layer that may contain the dye providing compound. A preferable mode is the case wherein the dye providing compound is contained in a light-sensitive layer.

The compound represented by formula (1) or (2) for use in the present invention can be introduced into layers of a heat-development light-sensitive material by a known method, such as the one described in U.S. Pat. No. 2,322,027. In this case, use is made of a high-boiling organic solvent as described, for example, in U.S. Pat. Nos. 4,555,470, 4,536,466, 4,536,467, 4,587,206, 4,555,476, and 4,599,296, and JP-B-3-62256 ("JP-B" means examined Japanese patent publication), if necessary, in combination with a low-boiling organic solvent having a boiling point of 50 to 160° C.

The high-boiling organic solvent is used in an amount of generally 50 g or less, preferably 10 g or less, per g of the compound represented by formula (1) or (2) to be used. The amount is also preferably 1 cc or less, more preferably 0.5 cc or less, and particularly preferably 0.3 cc or less, per g of the binder.

A dispersion method that uses a polymer, as described in JP-B-51-39853 and JP-A-51-59943, and a method wherein the addition is made with them in the form of a dispersion of fine particles, as described, for example, in JP-A-62-30242 can also be used.

If the compounds used in the light-sensitive material are hydrophobic, in dispersing the hydrophobic compound in a hydrophilic colloid, various surface-active agents can be used; examples that can be used are listed as surface-active agents, in JP-A-59-157636, pages (37) to (38).

Next, the compound represented by formula (A) is described.

formula (A)

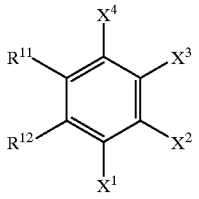

In the formula, $R^{11}$and $R^{12}$ each represent a hydrogen atom, a halogen atom (e.g., chlorine, bromine, and fluorine), a carboxyl group (that may form a salt with Na, K, or the like), a sulfo group (that may form a salt with Na, K, or the like), an alkyl group (that may be substituted by a halogen atom, a hydroxyl group, an alkoxy group, an aryl group, or the like, and that preferably has 1 to 15 carbon atoms in all, such as a methyl group, an ethyl group, a t-butyl group, and an n-pentadecyl group), an aryl group (that may be substituted by a halogen atom, an alkyl group, an alkoxy group, or the like, and that preferably has 6 to 30 carbon atoms in all, such as a 4-(n-dodecyloxy)phenyl group, a p-tolyl group, a 3,4-dichlorophenyl group, and a 4-dodecylphenyl group), an acylamino group (that may be substituted by an alkyl group, an aryl group, an aryloxy group, or the like, and that preferably has 2 to 30 carbon atoms in all, such as an acectylamino group, a benzoylamino group, and an α-(2,4-di-t-amylphenoxy)butylamido group), an alkoxy group (that may be substituted by a halogen atom, a hydrogen group, an aryl group, or the like, and that preferably has 1 to 10 carbon atoms in all, such as a methoxy group, an ethoxy group, and a butoxy group), an aryloxy group (of which the aryl residue may be substituted by a halogen atom, an alkyl group, an alkoxy group, or the like, and which has preferably 6 to 30 carbon atoms in all, such as a phenoxy group and a 4-n-dodecylphenoxy group), an alkylthio group (of which the alkyl residue may be substituted by a halogen atom, a hydroxyl group, an alkoxy group, or the like, and which has preferably 1 to 20 carbon atoms in all, such as a methylthio group and a hexadecylthio group), an arylthio group (of which the aryl residue may be substituted by a halogen atom, an alkyl group, an alkoxy group, or the like, and which has preferably 6 to 30 carbon atoms in all, such as a phenylthio group, a p-tolylthio group, and a 4-(n-dodecyloxy) phenylthio group), a carbamoylamino group (of which the carbamoyl residue may be substituted by an alkyl group, an aryl group, or the like, and which preferably has 2 to 20 carbon atoms in all, such as a group $NH_2CONH$- and an N-phenylcarbamoylamino group), an alkoxycarbonylamino group (of which the alkoxy residue may be substituted by a halogen atom, a hydroxyl group, an aryl group, or the like, and which preferably has 2 to 20 carbon atoms in all, such as a methoxycarbonylamino group and an ethoxycarbonylamino group), an aryloxycarbonylamino group (of which the aryl residue may be substituted by an alkyl group, chlorine, an alkoxy group, or the like, and which preferably has 7 to 30 carbon atoms in all, such as a phenoxycarbonylamino group), a carbamoyl group (preferably one having an alkyl group or an aryl group with 1 to 20 carbon atoms, such as an N,N-di(n-octyl)carbamoyl group), an acyl group (preferably one having an alkyl group or an aryl group with 1 to 20 carbon atoms, such as an acetyl group and an ethylcarbonyl group), an alkoxycarbonyl group (of which the alkoxy residue may be substituted by a halogen atom, a hydroxyl group, an aryl group, or the like, and which preferably has 2 to 20 carbon atoms in all, such as a methoxycarbonyl group and an ethoxycarbonyl group), an aryloxycarbonyl group (of which the aryl residue may be substituted by an alkyl group, chlorine, an alkoxy group, or the like, and which preferably has 7 to 30 carbon atoms in all, such as a phenoxycarbonyl group), a sulfamoyl group (which may be substituted by an alkyl group, an aryl group, or the like, and preferably has 0 to 20 carbon atoms in all, such as a group $NH_2SO_2$- and an N,N-dipropylsulfamoyl group), or a sulfonyl (preferably one having an alkyl group or an aryl group with 1 to 20 carbon atoms, such as a p-toluenesulfonyl group).

In formula (A), one of $X^1$, $X^2$, $X^3$, and $X^4$ represents a hydroxyl group, at least one of the rest represents a hydroxyl group, a sulfonamido group, or a carbonamido group, and each of the remaining others represents an atom or a group selected in the range of those represented by $R^{11}$ and $R^{12}$.

In the above, the sulfonamido group is a group represented by the following formula:

$—NHSO_2—R^{13}$ and the carbonamido group is $—NHCO—R^{13}$.

In the respective formulas, $R^{13}$ represents a substituted or unsubstituted aryl group (that may further be substituted by a halogen atom, an alkyl group, an alkoxy group, or the like, and that preferably has 6 to 30 carbon atoms in all, such as a 4-(n-dodecyloxy)phenyl group, a p-tolyl group, a 3,4-dichlorophenyl group, and a 4-dodecylphenyl group), an alkyl group (that may further be substituted by a halogen atom, a hydroxyl group, an aryloxy group, an alkoxy group, an aryl group, or the like, and that preferably has 1 to 30 carbon atoms in all, such as a methyl group, a trifluoromethyl group, an n-hexadecyl group, and a 1-(m-pentadecylphenoxy)propyl group), or an amino group (that may further be substituted by an alkyl group, an aryl group, or the like, and that preferably has 0 to 30 carbon atoms in all, such as a dimethylamino group and a dipropylamino group).

The total number of carbon atoms of $R^{11}$, $R^{12}$, $X^1$, $X^2$, $X^3$, and $X^4$ is required to be 10 or more for the purpose of suppressing the transfer of the compound from the layer, where it is added, to another layer.

Out of the compounds of formula (A), particularly preferable ones are compounds represented by the following formula (B):

formula (B)

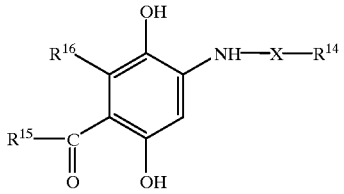

In formula (B), X represents —CO— or —$SO_2$—, $R^{14}$ and $R^{15}$ each represent an alkyl group, an aryl group, or a heterocyclic group, $R^{16}$ represents a hydrogen atom, a halogen atom, an aryl group, an acylamino group, an alkoxy group, an aryloxy group, an alkylthio group, an arylthio group, an acyl group, a sulfonyl group, a carbamoyl group, or a sulfamoyl group, $R^{15}$ and $R^{16}$ may together form a carbon ring or a heterocyclic ring, and a dimer or a trimer may be formed through $R^{14}$ or $R^{15}$.

$R^{14}$ and $R^{15}$ of formula (B) each represent an alkyl group (that includes those having a substituent, and that has 1 to 100 carbon atoms, such as methyl, ethyl, n-propyl, isopropyl, hexyl, 2-ethylhexyl, 2-hexyldecyl, n-dodecyl, and n-heptadecyl), an aryl group (that includes those having a substituent, and that has 5 to 100 carbon atoms, such as phenyl and naphthyl), or a heterocyclic group (that includes those having a substituent, and that has 1 to 100 carbon atoms, such as 2-pyridyl, 2-furyl, and benzoxazolyl).

These alkyl group, aryl group, or heterocyclic group may be substituted by a substituent selected from among an alkyl group, an aryl group (e.g., phenyl and naphthyl), an alkyloxy group (e.g., methoxy, myristyloxy, and methoxyethyloxy), an aryloxy group (e.g., phenyloxy, 2,4-di-tert-amylphenoxy, 3-tert-butyl-4-hydroxyphenyloxy, and naphthyloxy), a carboxy group, an alkylcarbonyl group (e.g., acetyl and tetradecanoyl), an arylcarbonyl group (e.g., benzoyl), an alkoxycarbonyl group (e.g., methoxycarbonyl and benzyloxycarbonyl), an aryloxycarbonyl group (e.g., phenyloxycarbonyl and p-tolyloxycarbonyl), an acyloxy group (e.g., acetyl, benzoyloxy, and phenylaminocarbonyloxy), a sulfamoyl group (e.g., N-ethylsulfamoyl and N-octadecylsulfamoyl), a carbamoyl group (e.g., N-ethylcarbamoyl and N-methyldodecylcarbamoyl), a sulfonamido group (e.g., methanesulfonamido, benzenesulfonamido, and ethylaminosulfonamido), an acylamino group (e.g., acetylamino, benzamido, ethoxycarbonylamino, and phenylaminocarbonylamino), a diacylamino group (e.g., succinimido and hydantoinyl), a sulfonyl group (e.g., methanesulfonyl), a hydroxyl group, a cyano group, a nitro group, and a halogen atom.

$R^{16}$ of formula (B) represents a hydrogen atom, a halogen atom (e.g., chlorine, bromine, and fluorine), or a substituted or unsubstituted aryl group (including those having a substituent, and having 6 to 100 carbon atoms, e.g., phenyl and naphthyl), acylamino group (including those having a substituent, and having 2 to 100 carbon atoms, e.g., acetylamino, n-butaneamido, 2-hexyldecaneamido, 2-(2',4'-di-t-amylphenoxy)butaneamido, and benzoylamino), alkoxy group (including those having a substituent, and having 1 to 100 carbon atoms, e.g., methoxy, ethoxy, butoxy, n-octyloxy, and methoxyethoxy), aryloxy group (including those having a substituent, and having 6 to 100 carbon atoms, e.g., phenoxy and 4-t-octylphenoxy), alkylthio group (including those having a substituent, and having 1 to 100 carbon atoms, e.g., butylthio and hexadecylthio), arylthio group (including those having a substituent, and having 6 to 100 carbon atoms, e.g., phenylthio and 4-dodecyloxyphenylthio), acyl group (having 2 to 100 carbon atoms, e.g. acetyl, benzoyl, and lauroyl), sulfonyl group (having 1 to 100 carbon atoms, e.g., methanesulfonyl, octanesulfonyl, benzenesulfonyl, and dodecylbenzenesulfonyl), carbamoyl group (having 1 to 100 carbon atoms, e.g., N,N-dioctylcarbamoyl), or sulfamoyl group (having 0 to 100 carbon atoms, e.g., N-butylsulfamoyl and N,N-dimethylsulfamoyl).

$R^{15}$ and $R^{16}$ of formula (B) may together form a 5- to 8-membered carbon ring or heterocyclic ring; and a dimer or a trimer may be formed through $R^{14}$ and $R^{15}$.

X represents —CO— or $SO_2$—, with —CO— more preferred.

The total number of carbon atoms of $R^{14}$, $R^{15}$ and $R^{16}$ of formula (B) is preferably 20 or more but 200 or less.

$R^{16}$ of formula (B) is preferably a hydrogen atom or a halogen atom.

Examples of the compound represented by formula (A) are described in detail, for example, in JP-A-60-119555, JP-A-60-198540, JP-A-62-203158, JP-A-1-120553, Japanese patent application Nos. 63-217271 and 63-197566, and JP-A-5-34884, any of which examples can be used. The amount of the compound of formula (A) to be used varies depending on the chemical species and the like, and it is not particularly restricted. The amount to be added is, for example, 0.01 to 5 mmol/$m^2$ per layer.

The compound of formula (A) is preferably added to an intermediate layer and, if necessary, it can also be added to a layer other than an intermediate layer, for example, a protective layer, an undercoat layer, or an image-forming layer, in addition to an intermediate layer.

Specific examples of the compound of formula (A) are shown below, but the present invention is not to be limited to those.

A-1
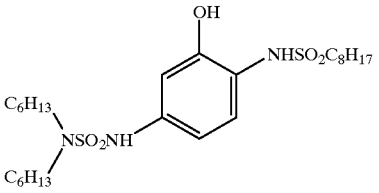
A-2
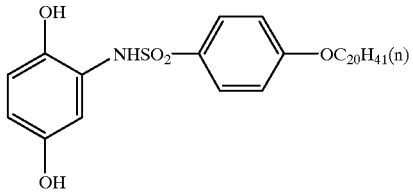
A-3
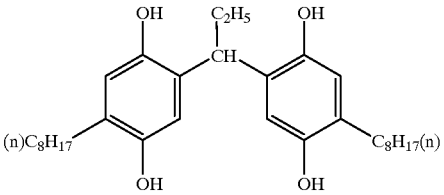
A-4
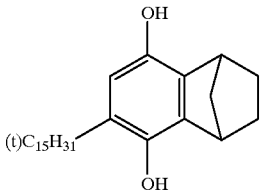
A-5
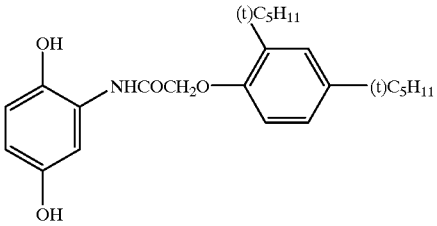
A-6
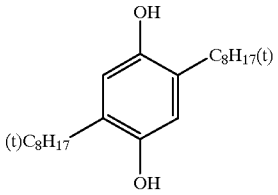
A-7
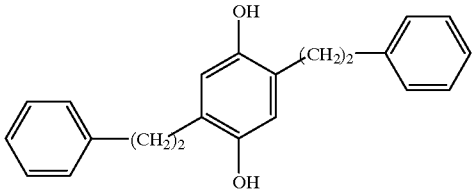
A-8
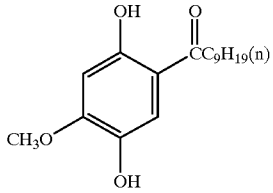
A-9
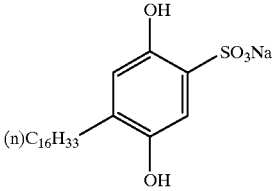
A-10
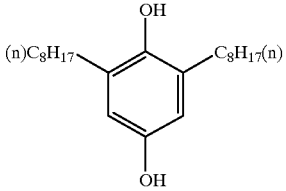
A-11
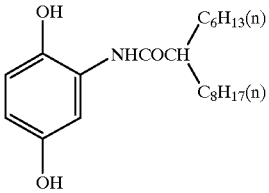
A-12
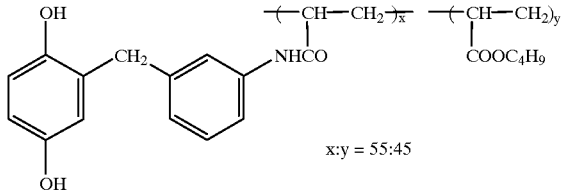
A-13
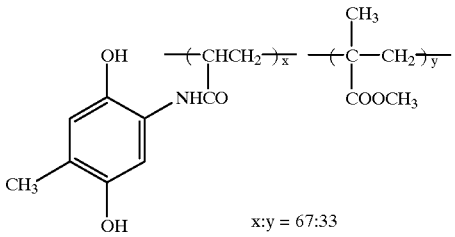
A-14
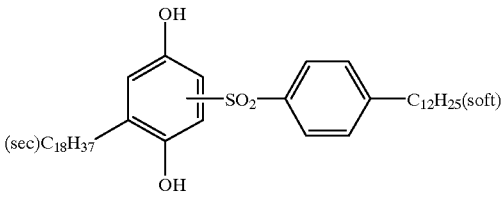

-continued
A-15
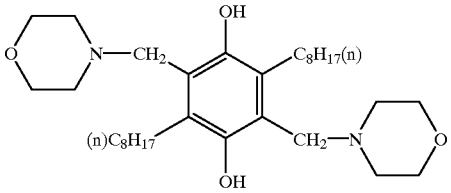
A-16
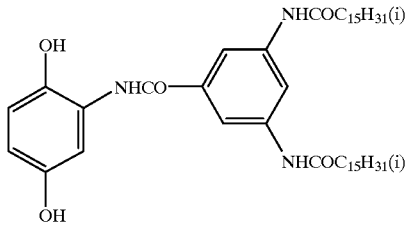
A-17
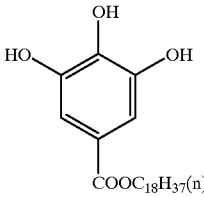
A-18
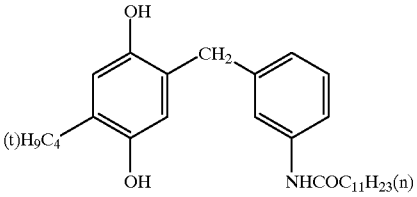
A-19
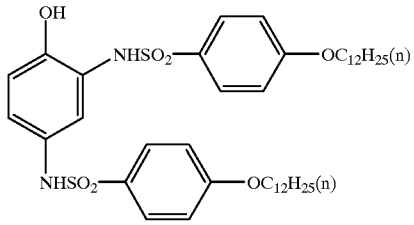
A-20
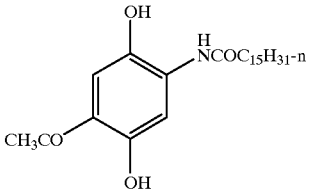
A-21
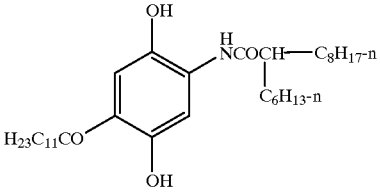
A-22
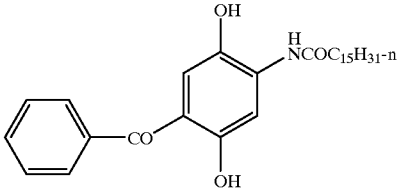
A-23
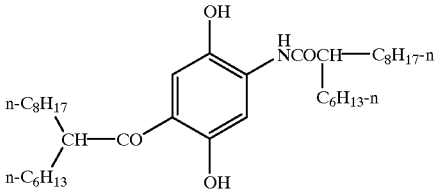
A-24
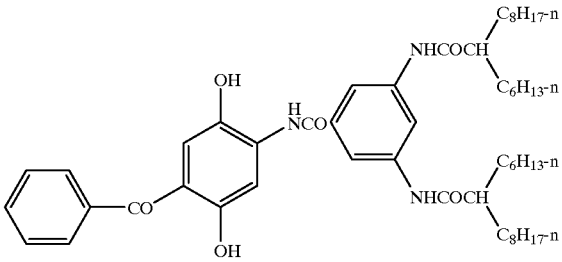
A-25
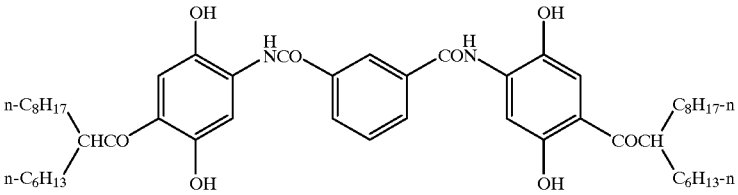
A-26
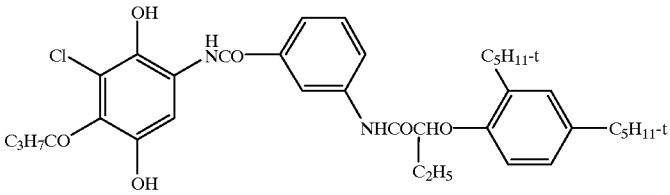

-continued

A-27

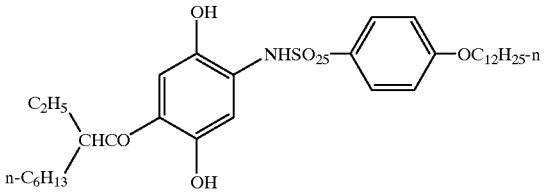

A-28

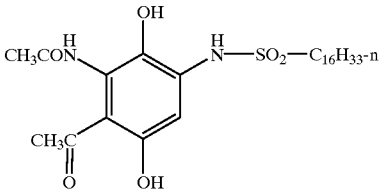

A-29

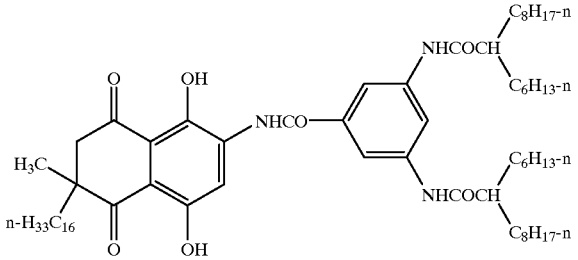

A-30

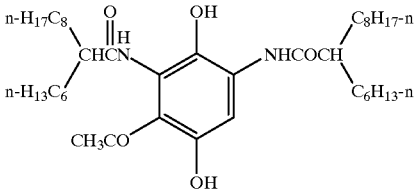

A-31

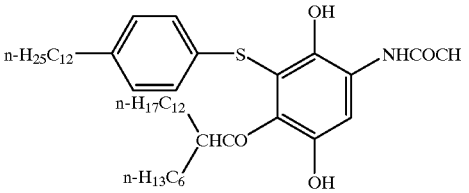

A-32

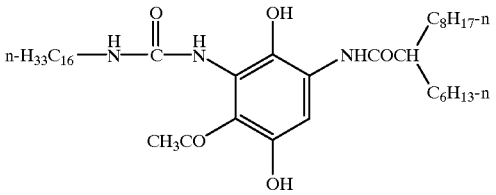

A-33

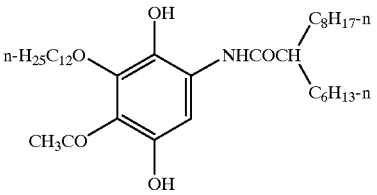

The coupler (scavenger) that can be used to react with the oxidized product of the compound represented by formula (1) or (2) to make it harmless, is described below.

The coupler is preferably contained in a layer (preferably an adjacent layer) other than silver halide emulsion layers, and it is suitable that the coupler reacts effectively with the oxidized product of the compound of formula (1) or (2) when the oxidized product is diffused from another layer.

The coupler used as a scavenger in the present invention may be a coupler capable of forming a non-diffusion dye or a non-dye-forming coupler. Preferable couplers of this type include compounds that are collectively referred to as active methylenes, 5-yrazolones, pyrazoloazoles, phenols, naphthols, and pyrrolotriazoles. For example, compounds referred to in RD No. 38957 (September 1996), pages 616 to 624, "x. Dye image formers and modifiers" can be used preferably.

These couplers can be classified into so-called two-equivalent couplers and four-equivalent couplers. As groups that serve as anionic coupling split-off groups of two-equivalent couplers, can be mentioned, for example, a halogen atom (e.g. chlorine and bromine), an alkoxy group (e.g., methoxy and ethoxy), an aryloxy group (e.g., phenoxy, 4-cyanophenoxy, and 4-alkoxycarbonylphenyl), an alkylthio group (e.g., methylthio, ethylthio, and butylthio), an arylthio group (e.g., phenylthio and tolylthio), an alkylcarbamoyl group (e.g., methylcarbamoyl, dimethylcarbamoyl, ethylcarbamoyl, diethylcarbamoyl, dibutylcarbamoyl, piperidylcarbamoyl, and morpholylcarbamoyl), an arylcarbamoyl group (e.g., phenylcarbamoyl, methylphenylcarbamoyl, ethylphenylcarbamoyl, and benzylphenylcarbamoyl), a carbamoyl group, an alkylsulfamoyl group (e.g., methylsulfamoyl, dimethylsulfamoyl, ethylsulfamoyl, diethylsulfamoyl, dibutylsufamoyl, piperidylsulfamoyl, and morpholylsulfamoyl), an arylsulfamoyl group (e.g., phenylsulfamoyl, methylphenylsulfamoyl, ethylphenylsulfamoyl, and benzylphenylsulfamoyl), a sulfamoyl group, a cyano group, an alkylsulfonyl group (e.g., methanesulfonyl and ethanesulfonyl), an arylsufonyl group (e.g., phenylsulfonyl, 4-chlorophenylsulfonyl, and p-toluenesulfonyl), an alkylcarbonyloxy group (e.g. acetyloxy, propionyloxy, and butyloyloxy), an arylcarbonyloxy group (e.g., benzoyloxy, toluyloxy, and anisyloxy), and a nitrogen-containing heterocyclic group (e.g., imidazolyl and benzotriazolyl).

Further, as groups that serve as cationic coupling split-off groups of four-equivalent couplers, can be mentioned, for example, a hydrogen atom, a formyl group, a carbamoyl group, a substituted methylene group (the substituent of which includes, for example, an aryl group, a sulfamoyl group, a carbamoyl group, an alkoxy group, an amino group, and a hydroxyl group), an acyl group, and a sulfonyl group.

In addition to the compounds described in the above RD No. 38957, couplers described below can be preferably used.

As active-methylene-series couplers, use can be made of couplers represented by formula (I) or (II) of EP-A-502,424; couplers represented by formula (1) or (2) of EP-A-513,496; couplers represented by formula (I) in claim 1 of EP-A-568,037A; couplers represented by formula (I) of U.S. Pat. No. 5,066,576, column 1, lines 45 to 55; couplers represented by formula (I) of JP-A-4-274425, paragraph number 0008; couplers described in claim 1 of EP-A-498,381(A1), page 40; couplers represented by formula (Y) of EP-A-447,969 (A1), page 4; and couplers represented by any of formulae (II) to (IV) of U.S. Pat. No. 4,476,219, column 7, lines 36 to 58.

As 5-pyrazorone-series magenta couplers, compounds described in JP-A-57-35858 and JP-A-51-20826 are preferable.

Preferable pyrazoloazole-series couplers are imidazo[1,2-b]pyrazoles described in U.S. Pat. No. 4,500,630, pyrazolo[1,5-b][1,2,4]triazoles described in U.S. Pat. No. 4,540,654, and pyrazolo[5,1-c][1,2,4]triazoles described in U.S. Pat. No. 3,725,067. Among these couplers, pyrazolo[1,5-b][1,2,4]triazoles are preferable in view of light fastness.

As the pyrazoloazole coupler, preferably use can be made of pyrazoloazole couplers having a branched alkyl group directly bonded to the 2-, 3-, or 6-position of the pyrazolotriazole group, as described in JP-A-61-65245; pyrazoloazole couplers containing a sulfonamide group in the molecule, as described in JP-A-61-65245; pyrazoloazole couplers having an alkoxyphenylsulfonamido ballasting group, as described in JP-A-61-147254; pyrazolotriazole couplers having an alkoxy group or an aryloxy group at the 6-position, as described in JP-A-62-209457 or JP-A-63-307453; and pyrazolotriazole couplers having a carbonamido group in the molecule, as described in JP-A-2-201443.

Preferable examples of the phenol-series couplers include 2-alkylamino-5-alkylphenol couplers described, for example, in U.S. Pat. Nos. 2,369,929, 2,801,171, 2,772,162, 2,895,826, and 3,772,002; 2,5-diacylaminophenol couplers described, for example, in U.S. Pat. Nos. 2,772,162, 3,758,308, 4,126,396, 4,334,011, and 4,327,173, West Germany Patent Publication No. 3,329,729, and JP-A-59-166956; and 2-phenylureido-5-acylaminophenol couplers described, for example, in U.S. Pat. Nos. 3,446,622, 4,333,999, 4,451,559, and 4,427,767.

Preferable examples of the naphthol-series couplers include 2-carbamoyl-1-naphthol couplers described, for example, in U.S. Patent Nos. 2,474,293, 4,052,212, 4,146,396, 4,228,233, and 4,296,200; and 2-carbamoyl-5-amido-1-naphthol couplers described, for example, in U.S. Pat. No. 4,690,889.

Preferable examples of the pyrrolotriazole-series couplers include those described in European Patent Nos. 488,248A1, 491,197A1, and 545,300.

Further, a fused-ring phenol, imidazole, pyrrole, 3-hydroxypyridine, active methine, 5,5-ring-fused heterocyclic, and 5,6-ring-fused heterocyclic coupler, can be used.

As the fused-ring phenol-series couplers, those described, for example, in U.S. Pat. Nos. 4,327,173, 4,564,586, and 4,904,575, can be used.

As the imidazole-series couplers, those described, for example, in U.S. Pat. Nos. 4,818,672 and 5,051,347, can be used.

As the pyrrole-series couplers, those described, for example, in JP-A-4-188137 and JP-A-4-190347 can be used.

As the 3-hydroxypyridine-series couplers, those described, for example, in JP-A-1-315736, can be used.

As the active methine-series couplers, those described, for example, in U.S. Pat. Nos. 5,104,783 and 5,162,196, can be used.

As the 5,5-ring-fused heterocyclic couplers, for example, pyrrolopyrazole couplers described in U.S. Patent No. 5,164,289, and pyrroloimidazole couplers described in JP-A-4-174429, can be used.

As the 5,6-ring-fused heterocyclic couplers, for example, pyrazolopyrimidine couplers described in U.S. Pat. No. 4,950,585, pyrrolotriazine couplers described in JP-A-4-204730, and couplers described in European Pat. No. 556,700, can be used.

In the present invention, in addition to the above couplers, use can be made of couplers described, for example, in West Germany Pat. Nos. 3,819,051A and 3,823,049, U.S. Pat. Nos. 4,840,883, 5,024,930, 5,051,347, and 4,481,268, European Pat. Nos. 304,856A2, 329,036, 354,549A2, 374,781A2, 379,110A2, and 386,930A1, and JP-A Nos. 63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731, and 4-204732.

The amount of these couplers to be used is generally 0.05 to 10 mmol/$m^2$, and preferably 0.1 to 5 mmol/$m^2$.

Further, functional couplers as shown below may be included in a hydrophilic colloidal layer.

As a compound (including a coupler) that reacts with the oxidized product of a developing agent to release a residue of a photographically useful compound, in addition to the above compounds for use in the present invention, the following can be listed: Development-inhibitor-releasing compounds: compounds represented by formula (I), (II), (III), or (IV) described in EP-A-378,236(A1), page 11, compounds represented by formula (I) described in EP-A-436,938(A2), page 7, compounds represented by formula (1) described in EP-A-568,037, and compounds represented by formula (I), (II), or (III) described in EP-A-440,195(A2), pages 5 to 6; Bleaching-accelerator-releasing compounds: compounds represented by formula (I) or (I') described in page 5 of EP-A-310,125(A2), and compounds represented by formula (I) in claim 1 of JP-A-6-59411.

Specific examples of couplers for use in the present invention are shown below, but the present invention is not limited to them.

C-1
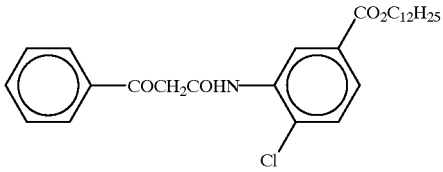
C-2
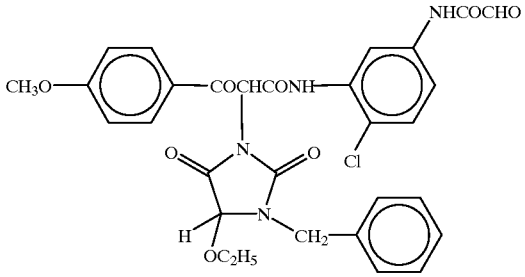
C-3
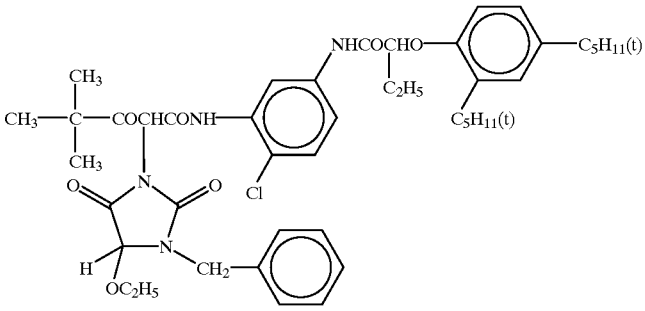
C-4
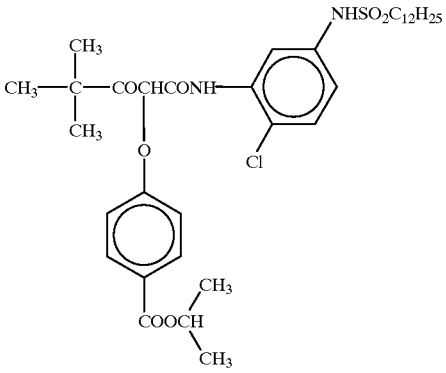
C-5
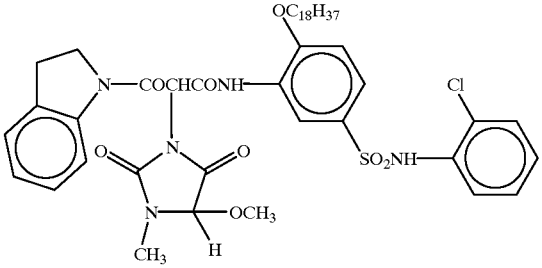
C-6
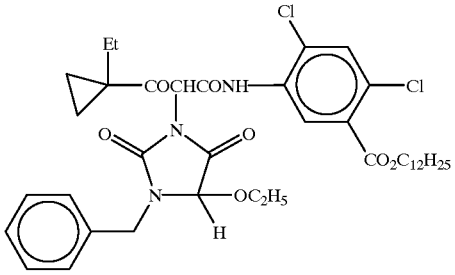
C-7
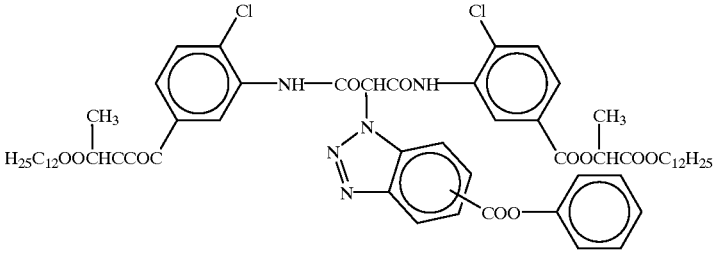

-continued
C-8
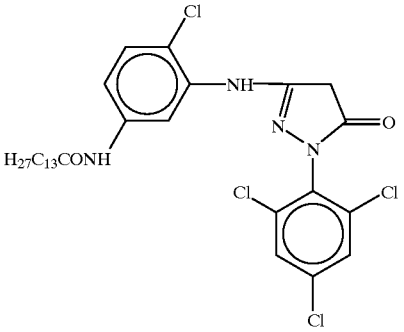
C-9
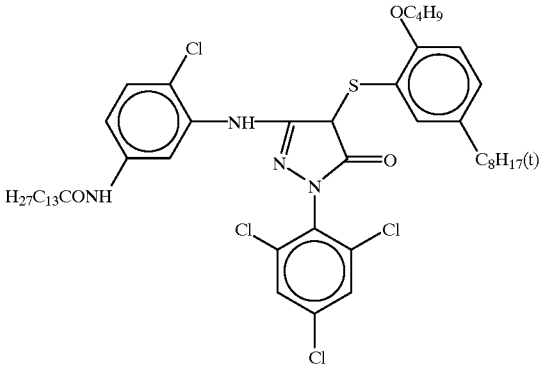
C-10
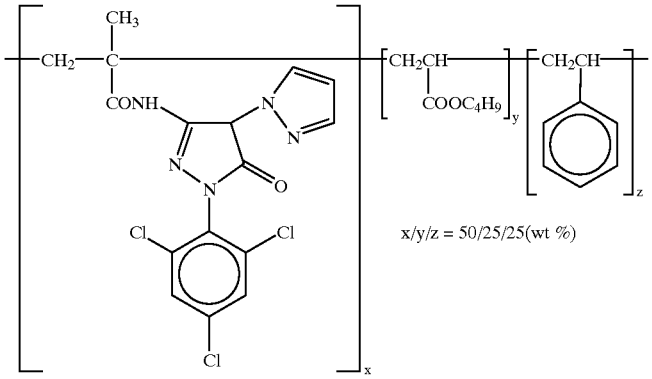
C-11
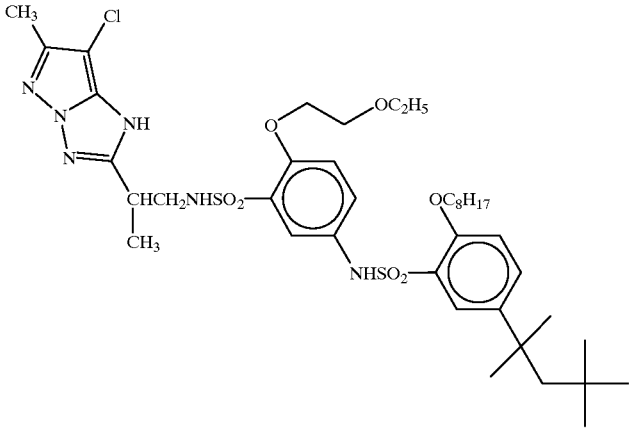
C-12
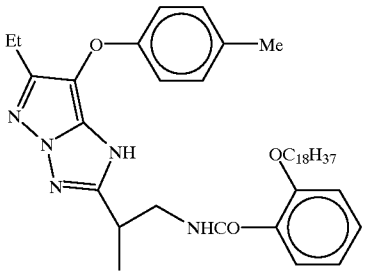

-continued
C-13
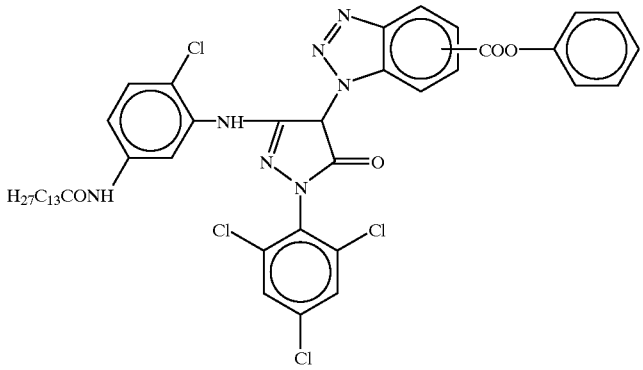
C-14
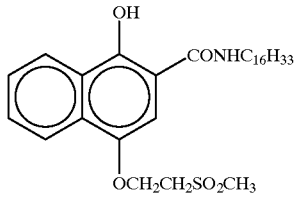
C-15
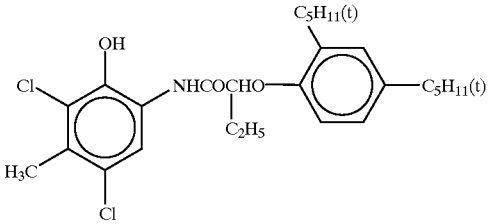
C-16
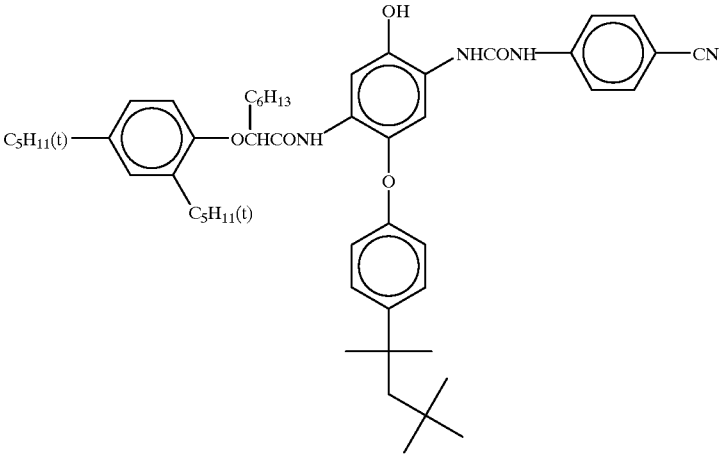
C-17
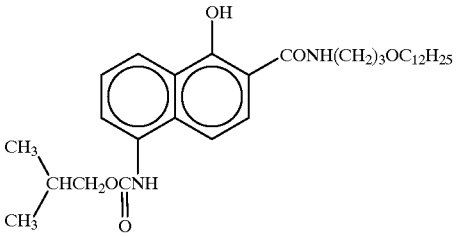
C-18
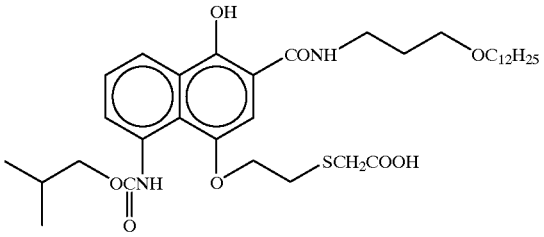

-continued

C-19

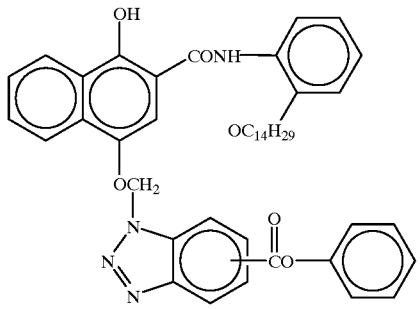

C-20

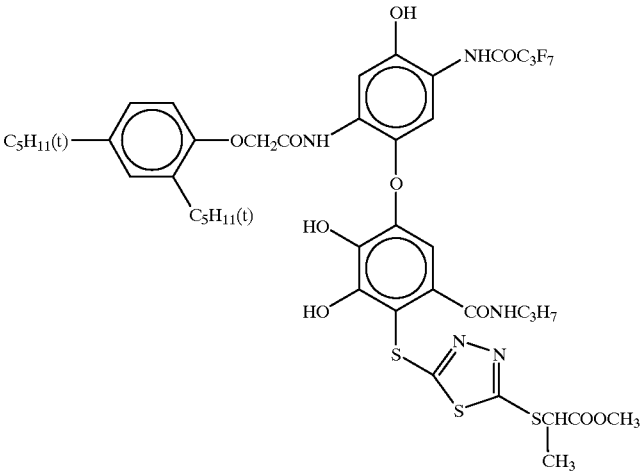

C-21

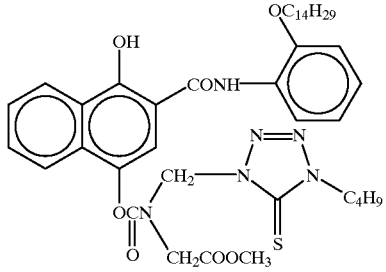

C-22

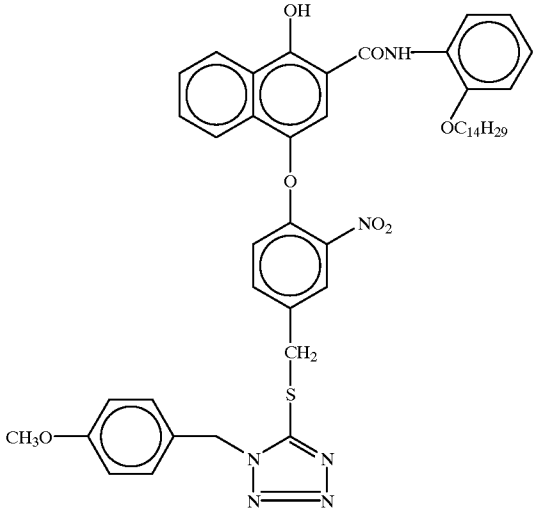

Now, the dye providing compounds used in the present invention are described. The dye providing compounds are roughly classified into compounds that form or release diffusion dyes in proportion to or in reverse proportion to the development of a silver halide, and compounds that form or release non-diffusion dyes in proportion to or in reverse proportion to the development of a silver halide. Generally, the former diffusion dyes are used as dye images by transferring to a dye fixing element, and the latter non-diffusion dyes are used as dye images by fixing there.

As the former compounds that form or release diffusion dyes, oxidation-reduction compounds containing an existing dye (or its precursor), and color couplers that form dyes by coupling reaction with the oxidized product of a color developing agent, are typical.

Specific examples of such compounds that form or release diffusion dyes include compounds described, for example, in U.S. Pat. No. 4,500,626, U.S. Pat. No. 4,483,914, U.S. Pat. No. 4 503 137, U.S. Pat. No. 4,559,290, U.S. Pat. No. 4,783,396, JP-A-58-149049, JP-A-60-133449, JP-A-59-218443, JP-A-61-238056, EP-A-210 660 (A2), and Journal of Technical Disclosure No. 87-6199 (Vol. 12, No. 22), as described in BACKGROUND OF THE INVENTION, and compounds described in JP-A-8-101487, paragraph Nos.

0072 to 0085. Typical examples of the compounds include, for example, diffusion dye couplers, diffusion dye releasing redox compounds (o- or p-sulfonamido-substituted phenol compounds), dye developing agents, and compounds that release a dye by formation of a ring.

Further, specific examples of the couplers that form a diffusible dye include, for example, those described in JP-A-9-152705, paragraph Nos. 0038 to 0066.

The dye providing compounds to be contained in the at least two silver halide emulsion layers different in light sensitivity from each other may be the same or different from each other.

On the other hand, preferable examples of the coupler that forms a non-diffusion dye include compounds that are collectively referred to as active methylenes, 5-pyrazolones, pyrazoloazoles, phenols, naphthols, and pyrrolotriazoles. Specific examples thereof are those referred to in Research Disclosure No. 38957 (September 1996), pages 616 to 624, which can be preferably used. As particularly preferable examples, can be mentioned pyrazoloazole couplers as described in JP-A-8-110608 and pyrrolotriazole couplers described, for example, in JP-A-8-122994 and JP-A-9-218496. These dye providing compounds each are generally used in an amount of 0.05 to 10 mmol/$m^2$ and preferably 0.1 to 5 mmol/$m^2$ for each color.

As the color developing agent that undergoes the oxidation coupling reaction with the above coupler, the above-described electron transfer agent represented by formula (1) or (2) functions in some cases, but an aromatic primary amine developing agent, such as p-phenylenediamines and p-aminophenols, may also be used.

Further, preferable examples also include, for example, sulfonamidophenols described, for example, in JP-A-8-110608, JP-A-8-122994, JP-A-8-146578, JP-A-9-15806, JP-A-9-146248, and Japanese patent application Nos. 8-357191 and 9-365629, sulfonylhydrazines described in EP-A-545 491A, JP-A-8-166664, and JP-A-8-227131, carbamoylhydrazines described in JP-A-8-286340, sulfonylhydrazones described in JP-A-8-202002, and carbamoylhydrazones described in JP-A-8-234390.

The color developing agents are used singly or as a combination of two or more, and it is suitable that the total amount thereof to be used is generally 0.05 to 20 mmol/$m^2$ and preferably 0.1 to 10 mmol/$m^2$.

Next, techniques that are desirably used in combination with the present invention are described.

The heat-development color photographic light-sensitive material of the present invention has basically, on a base, light-sensitive silver halide emulsions, a dye providing compound, a compound represented by formula (1) or (2), a compound represented by formula (A) or a coupler, and a binder; and, if necessary, it can further contain an organometallic salt oxidizing agent and the like.

When a colored dye providing compound is allowed to present in a lower layer of a silver halide emulsion, it is preferable because the sensitivity is prevented from lowering.

In order to obtain colors ranging widely on the chromaticity diagram by using three primary colors: yellow, magenta, and cyan, use is made of a combination of at least three silver halide emulsion layers photosensitive to respectively different spectral regions. For examples, a combination of three layers of a blue-sensitive layer, a green-sensitive layer, and a red-sensitive layer, and a combination of a green-sensitive layer, a red-sensitive layer, and an infrared-sensitive layer, and a combination of a red-sensitive layer, an infrared-sensitive layer (1), and an infrared-sensitive layer (2), as described in JP-A-59-180550, JP-A-64-13546, JP-A-62-253159, and EP-A-479,167, can be mentioned. The photosensitive layers can be arranged in various orders known generally for color photographic materials. Further, each of these photosensitive layers can be divided into two or more layers if necessary, as described in JP-A-1-252954.

In the heat-development photographic material, various non-light-sensitive layers can be provided, such as a protective layer, an underlayer, an intermediate layer, a yellow filter layer, an antihalation layer, and a backing layer, between the above silver halide emulsion layers or as the uppermost layer or the lowermost layer.

Next, silver halide emulsion used in the heat-development light-sensitive material is described in detail.

The silver halide emulsion that can be used in the present invention may be made of any of silver chloride, silver bromide, silver iodobromide, silver chlorobromide, silver chloroiodide, and silver chloroiodobromide.

The silver halide emulsion that is used in the present invention may be a surface-latent-image-type emulsion or an internal-latent-image-type emulsion. The internal-latent-image-type emulsion is used in combination with a nucleator or a light-fogging agent to be used as a direct reversal emulsion. A so-called core-shell emulsion, wherein the grain inside and the grain surface layer have different phases, and an emulsion wherein silver halides different in composition are joined epitaxially, may be used. The silver halide emulsion may be a monodisperse or a polydisperse emulsion. A technique is preferably used wherein the gradation is adjusted by mixing monodisperse emulsions, as described in JP-A-1-167743 or JP-A-4-223643. The grain size is preferably 0.1 to 2 $\mu$m, and particularly preferably 0.2 to 1.5 $\mu$m.

The crystal habit of the silver halide grains may be any of regular crystals, such as cubic crystals, octahedral crystals and tetradecahedral crystals; irregular crystals, such as spherical crystals and tabular crystals having a high aspect ratio; crystals having crystal defects, such as twin planes, or other composite crystals of these. As a tabular grains, those having an aspect ratio of 8 or over (further 20 or over) are preferable, and their thickness is preferably 0.3 $\mu$m or less, more preferable 0.2 $\mu$m or less, particularly preferably 0.1 $\mu$m or less. It is preferable to use an emulsion in which such tabular grains occupy 50% or more, more preferably 80% or more, further preferably 90% or more of all the projected area of the silver halide grains.

The light-sensitive silver halide emulsion that is used in the present invention may contain a heavy metal, such as iridium, rhodium, platinum, cadmium, zinc, thallium, lead, iron, and, osmium, for various purposes. The compounds of the heavy metal may be used singly or in the form of a combination of two or more. The amount to be added varies depending on the purpose of the application; but the amount is generally on the order of $10^{-9}$ to $10^{31\ 3}$ mol per mol of the silver halide. When they are incorporated, they may be incorporated uniformly in the grains, or they may be localized in the grains or on the surface of the grains. Specifically, emulsions described, for example, in JP-A-2-236542, JP-A-1-116637, and JP-A-5-181246 are preferably used.

The light-sensitive silver halide emulsion is generally a chemically sensitized silver halide emulsion. To chemically sensitize the light-sensitive silver halide emulsion for use in the present invention, for example, a chalcogen sensitization method, such as a sulfur sensitization method, a selenium sensitization method, and a tellurium sensitization method; a noble metal sensitization method, wherein gold, platinum, or palladium is used; and a reduction sensitization method, which are known for emulsions for usual-type light-sensitive materials, can be used alone or in combination (e.g. JP-A-3-110555 and JP-A-5-241267). These chemical sensitizations can be carried out in the presence of a nitrogen-containing heterocyclic compound (JP-A-62-253159). Further, the below-mentioned antifoggant can be added after the completion of the chemical sensitization. Specifically, methods described in JP-A-5-45833 and JP-A-62-40446 can be used.

At the time of the chemical sensitization, the pH is preferably 5.3 to 10.5, and more preferably 5.5 to 8.5, and the pAg is preferably 6.0 to 10.5, and more preferably 6.8 to 9.0.

The coating amount of the light-sensitive silver halide used in the present invention is generally in the range of 1 mg to 10 g/m$^2$ in terms of silver, and preferably 10 mg to 10 g/m$^2$ in terms of silver.

When the photosensitive silver halide used in the present invention is made to have color sensitivities of green sensitivity, red sensitivity, and infrared sensitivity, the photosensitive silver halide emulsion is spectrally sensitized with methine dyes or the like. If required, the blue-sensitive emulsion may be spectrally sensitized in the blue region.

Dyes that can be used include cyanine dyes, merocyanine dyes, composite cyanin dyes, composite merocyanine dyes, halopolar cyanine dyes, hemicyanine dyes, styryl dyes, and hemioxonol dyes.

Specifically, sensitizing dyes described, for example, in U.S. Pat. No. 4,617,257 and JP-A-59-180550, JP-A-64-13546, JP-A-5-45828, and JP-A-5-45834 can be mentioned.

These sensitizing dyes can be used singly or in combination, and a combination of these sensitizing dyes is often used, particularly for the purpose of adjusting the wavelength of the spectral sensitivity, and for the purpose of supersensitization.

Together with the sensitizing dye, a dye having no spectral sensitizing action itself, or a compound that does not substantially absorb visible light and that exhibits supersensitization, may be included in the emulsion (e.g. those described, for example, in U.S. Pat. No. 3,615,641 and JP-A-63-23145).

The time when these sensitizing dyes are added to the emulsion may be at a time of chemical ripening or before or after chemical ripening. Further, the sensitizing dye may be added before or after the formation of nuclei of the silver halide grains, in accordance with U.S. Pat. No. 4,183,756 and U.S. Pat. No. 4,225,666. Further, these sensitizing dyes and supersensitizers may be added in the form of a solution of an organic solvent, such as methanol, or in the form of a dispersion of gelatin, or in the form of a solution of a surface-active agent. Generally the amount of the sensitizing dye to be added is of the order of $10^{-8}$ to $10^{-2}$ mol per mol of the silver halide.

These additives used in the above process, and conventionally known additives for photography that can be used in the heat-development light-sensitive materials and dye-fixing materials in the present invention, are described in Research Disclosure No. 17643; Research Disclosure No. 18176; and Research Disclosure No. 307105, whose particular parts are given below in a table.

| Additive | RD 17643 | RD 18716 | RD 307105 |
|---|---|---|---|
| 1 Chemical sensitizers | p.23 | p.648 (right column) | p.866 |

-continued

| Additive | RD 17643 | RD 18716 | RD 307105 |
|---|---|---|---|
| 2 Sensitivity-enhancing agents | — | p.648 (right column) | — |
| 3 Spectral sensitizers and Supersensitizers | pp.23–24 | pp.648 (right column)–649 (right column) | pp.866–868 |
| 4 Brightening agents | p.24 | pp.648 (right column) | p.868 |
| 5 Antifogging agents and Stabilizers | pp.24–25 | p.649 (right column) | pp.868–870 |
| 6 Light absorbers, Filter dyes, and UV Absorbers | pp.25–26 | pp.649 (right column)–650 (left column) | p.873 |
| 7 Image dye stabilizers | p.25 | p.650 (left column) | p.872 |
| 8 Hardeners | p.26 | p.651 (left column) | pp.874–875 |
| 9 Binders | p.26 | p.651 (left column) | pp.873–874 |
| 10 Plasticizers and Lubricants | p.27 | p.650 (right column) | p.876 |
| 11 coating aids and Surfactants | pp.26–27 | p.650 (right column) | pp.875–876 |
| 12 Antistatic agents | p.27 | p.650 (right column) | pp.876–877 |
| 13 Matting agents | — | — | pp.878–879 |

As the binder of the constitutional layer of the heat-development light-sensitive material, the dye fixing material, or the processing material, a hydrophilic binder is preferably used. Examples thereof include those described in the above-mentioned Research Disclosures and JP-A-64-13546, pages (71) to (75). Specifically, a transparent or semitransparent hydrophilic binder is preferable, and examples include proteins, such as gelatin and gelatin derivatives; cellulose derivatives; such natural compounds as polysaccharides, including starches, acacia, dextrans, and pullulan; and such synthetic polymer compounds as polyvinyl alcohols,.polyvinyl pyrrolidones, and acrylamide polymers. Highly water-absorptive polymers described, for example, in U.S. Pat. No. 4,960,681 and JP-A-62-245260; that is, homopolymers of vinyl monomers having —COOM or —$SO_3M$ (M represents a hydrogen atom or an alkali metal), or copolymers of these vinyl monomers, or this vinyl monomer(s) with another vinyl monomer (e.g., those comprising sodium methacrylate or ammonium methacrylate, including Sumika Gel L-5H, trade name, manufactured by Sumitomo Chemical Co., Ltd.) can also be used. Two or more of these binders can be combined and used. Particularly, combinations of gelatin with the above binders are preferable. As the gelatin, lime-processed gelatin, acid-processed gelatin, or so-called de-ashed gelatin, wherein the contents of calcium, etc., are reduced, can be selected to meet various purposes, and combinations of these gelatins are also preferably used.

If a system wherein the heat development is carried out with a slight amount of water supplied is adopted, the absorption of water can be rapidly carried out by using the above high-water-absorptive polymer. Further, when the high-water-absorptive polymer is used in the dye fixing layer or its protective layer, after the transfer the dye can be prevented from transferring again from the dye fixing element to another material.

In the present invention, the coating amount of the binder is preferably 0.2 to 20 g, more preferably 0.2 to 10 g, and most preferably 0.5 to 7 g per m$^2$.

In the present invention, the light-sensitive silver halide emulsion may be used together with an organic metal salt as an oxidizing agent. Among the organic metal salts, organosilver salt is particularly preferably used.

As the organic compound that can be used to form the above organosilver salt oxidizing agent, benzotriazoles, aliphatic acids, and other compounds, as described in U.S. Pat. No. 4,500,626, columns 52 to 53, can be mentioned. Also useful is acetylene silver described in U.S. Pat. No. 4,775,613. organosiliver salts may be used in the form of a combination of two or more.

The above organosilver salts may be used additionally in an amount of generally 0.01 to 10 mol, and preferably 0.01 to 1 mol, per mol of the light-sensitive silver halide. The coating amount of the light-sensitive silver halide emulsion is generally 0.05 to 10 g/m$^2$, and preferably 0.1 to 4 g/m$^2$, in terms of silver.

As the reducing agent that can be used in the present invention, known reducing agents can be used. Further, the later-described dye providing compounds having reducibility are also included (in this case, another reducing agent can be used additionally). Reducing agent precursors that have no reducibility themselves but exhibit reducibility by the action of heat or a nucleophilic agent during the process of development, can be used.

Examples of the reducing agent that can be used in the present invention include reducing agents and reducing agent precursors described, for example, in U.S. Pat. No. 4,500,626, columns 49 to 50, U.S. Pat. No. 4,839,272, U.S. Pat. No. 4,330,617, U.S. Pat. No. 4,590,152, U.S. Pat. No. 5,017,454, U.S. Pat. No. 5,139,919, JP-A-60-140335, pages (17) to (18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546, pages (40) to (57), JP-A-1-120553, JP-A-2-32338, JP-A-2-35451, JP-A-2-234158, JP-A-3-160443, and EP-A-220 746, pages 78 to 96.

Combinations of various reducing agents as disclosed in U.S. Pat. No. 3,039,869 can also be used.

Further, the above reducing agents can be used in intermediate layers and protective layers for various purposes, for example, of the color mixing inhibition, the improvement of color reproduction, the improvement of the white background, and the prevention of silver from migrating to the dye fixing material. Specifically, reducing agents described in EP-A-524 649, EP-A-357 040, JP-A-4-249245, JP-A-2-64633, JP-A-2-46450, and JP-A-63-186240 are preferably used. Reducing compounds that release a development inhibitor as described in JP-B-3-63733, JP-A-1-150135, JP-A-2-110557, JP-A-2-64634, JP-A-3-43735, and EP-A-451 833 can also be used. A mode of JP-A-5-127335 wherein a hydroquinone is added to a protective layer can also be preferably used.

The amount of the reducing agent to be added in the present invention is generally 0.001 to 20 mol and particularly preferably 0.01 to 10 mol per mol of silver.

Hydrophobic additives used in the present invention, such as dye providing (dye-donative) compounds and nondiffusion reducing agents, can be introduced into photographic constitutional layers of a heat-development photographic material by a known method, such as the one described in U.S. Pat. No. 2,322,027. In this case, use can be made of a high-boiling organic solvent as described, for example, in U.S. Pat. No. 4,555,470, U.S. Pat. No. 4,536,466, U.S. Pat. No. 4 536 467, U.S. Pat. No. 4,587,206, U.S. Pat. No. 4,555,476, U.S. Pat. No. 4,599,296, and JP-B-3-62256, if necessary, in combination with a low-boiling organic solvent having a boiling point of 50 to 160° C. These dye providing compounds, nondiffusion reducing agents, high-boiling organic solvents, and the like can be used in the form of a combination of two or more.

The high-boiling organic solvent is used in an amount of generally 10 g or less, preferably 5 g or less, and more preferably 1 g to 0.1 g, per g of the dye providing compound. The amount is also generally 1 cc or less, particularly 0.5 cc or less, and more particularly 0.3 cc or less, per g of the binder.

A dispersion method that uses a polymer, as described in JP-B-51-39853 and JP-A-51-59943, and a method wherein the addition is made with them in the form of a dispersion of fine particles, as described, for example, in JP-A-62-30242, can also be used.

If the hydrophobic additives are compounds substantially insoluble in water, besides the above methods, a method can be used wherein the compounds may be made into fine particles to be dispersed and contained in a binder.

In dispersing the hydrophobic compound in a hydrophilic colloid, various surface-active agents can be used. Examples of the surface-active agents that can be used are listed in JP-A-59-157636, pages (37) to (38), and in the Research Disclosure (RD) publication shown above.

In the heat-development light-sensitive material of the present invention, use can be made of a compound that can activate the development and make the image stable. Preferable specific compounds for use are described in U.S. Pat. No. 4,500,626, the 51st column to the 52nd column.

In the system for forming an image by diffusion transfer of a dye, various compounds can be added to the constitutional layers of the heat-development light-sensitive material of the present invention, for the purpose of fixing unnecessary dyes or colored substances or rendering them colorless, to improve the white background of the resulting image.

Specifically, compounds described in EP-A-353 741, EP-A-461 416, JP-A-63-163345, and JP-A-62-203158 can be used.

For the structure of layers of the heat-development light-sensitive material of the present invention, various pigments and dyes can be used for the purpose of improving color separation and making sensitivity high.

Specifically, compounds described in the above Research Disclosures and compounds and layer structures described, for example, in EP-A-479 167, EP-A-502 508, JP-A-1-167838, JP-A-4-343355, JP-A-2-168252, JP-A-61-20943, EP-A-479 167, and EP-A-502 508 can be used.

In the case wherein an image is formed by diffusion transfer of a dye, a dye fixing material is used together with the heat-development light-sensitive material. The dye fixing material may be either in the form wherein the dye fixing material is applied on a base different from that of the light-sensitive material, or in the form wherein the dye fixing material is applied on the same base as that of the light-sensitive material. As for the mutual relationship of the light-sensitive material to the dye fixing material, and the relationship thereof to the base, and to the white reflective layer, the relationship described in U.S. Pat. No. 4,500,626, column 57, can also be applied to the present invention.

The dye fixing material preferably used in the present invention has at least one layer containing a mordant and a binder. As the mordant, one known in the field of photography can be used and specific examples thereof include mordants described in U.S. Pat. No. 4,500,626, columns 58 to 59, JP-A-61-88256, pages (32) to (41), and JP-A-1-

161236, pages (4) to (7), and those described, for example, in U.S. Pat. No. 4,774,162, U.S. Pat. No. 4,619,883, and U.S. Pat. No. 4,594,308. Further, dye accepting polymer compounds as described in U.S. Pat. No. 4,463,079 may be used.

In the present invention, when the light-sensitive material through which shooting has been made is subjected to heat development, a processing material other than the dye fixing material can be used. The processing material contains at least a base and/or a base precursor. The most preferable ones thereof are systems described in EP-210 660 and U.S. Pat. No. 4,740,445 wherein a base is generated by means of a combination of a basic metal compound hardly soluble in water with a compound that can undergo a complex formation reaction with the metal ion constituting the basic metal compound using water as a medium. In this case, although preferably the basic compound hardly soluble in water is added to the light-sensitive material and the complex forming compound is added to the processing material, that can be reversed. A preferable combination of compounds is a system wherein fine particles of zinc hydroxide are used in the light-sensitive material and a base of picolinic acid, such as guanidine picolinate, is used in the processing material.

Example methods of exposing the heat-development light-sensitive material to light and recording the image, include a method wherein a landscape, a man, or the like is directly photographed by a camera or the like; a method wherein a reversal film or a negative film is exposed to light using, for example, a printer, or an enlarging apparatus; a method wherein an original picture is subjected to scanning exposure through a slit by using an exposure system of a copying machine or the like; a method wherein light-emitting diodes and various lasers (e.g. laser diodes and gas lasers) are allowed to emit light, to carry out scanning exposure through image information and electrical signals (methods described, for example, in JP-A-2-129625, JP-A-5-176144, JP-A-5-199372, JP-A-6-127021); and a method wherein image information is outputted to an image display apparatus, such as a CRT, a liquid crystal display, an electroluminescence display, and a plasma display, and exposure is carried out directly or through an optical system.

Light sources that can be used for recording an image on the heat-development light-sensitive material, as mentioned above, include natural light and light sources and exposure methods described in U.S. Pat. No. 4,500,626, column 56, and JP-A-2-53378 and JP-A-2-54672, such as a tungsten lamp, a light-emitting diode, a laser light source, and a CRT light source.

Image-wise exposure can be carried out by using a wavelength-converting element that uses a nonlinear optical material and a coherent light source, such as laser rays, in combination. Herein the term "nonlinear optical material" refers to a material that can develop nonlinearity of the electric field and the polarization that appears when subjected to a strong photoelectric field, such as laser rays, and inorganic compounds, represented by lithium niobate, potassium dihydrogenphosphate (KDP), lithium iodate, and $BaB_2O_4$; urea derivatives, nitroaniline derivatives, nitropyridine-N-oxide derivatives, such as 3-methyl-4-nitropyridine-N-oxide (POM); and compounds described in JP-A-61-53462 and JP-A-62-210432 can be preferably used. As the form of the wavelength-converting element, for example, a single crystal optical waveguide type and a fiber type are known, both of which are useful.

The above image information can employ, for example, image signals obtained from video cameras, electronic still cameras, and the like; television signals, represented by Nippon Television Singo Kikaku (NTSC); image signals obtained by dividing an original picture into a number of picture elements by a scanner or the like; and an image signals produced by a computer, represented by CG or CAD.

The heat-development light-sensitive material and/or the dye fixing material of the present invention may be in the form that has an electroconductive heat-generating material layer as a heating means for heat development and diffusion transfer of the dye. In this case, as the heat-generating element, one described, for example, in JP-A-61-145544 can be employed.

The heating temperature in the heat development process is generally about 50 to 250° C. and particularly a heating temperature of about 60 to 180° C. is useful. The diffusion transfer process of the dye may be carried out simultaneously with the heat development or after the completion of the heat development process. In the latter case, the heating temperature in the transfer process may be in the range from the temperature in the heat development process to the room temperature and is preferably particularly 50° C. or more to a temperature about 10° C. lower than the heat development process.

Although the transfer of the dye can be brought about only by heat, a solvent may be used to accelerate the dye transfer. Further, it is also useful to use a method described, for example, in U.S. Pat. No. 4,704,345, U.S. Pat. No. 4,740,445, and JP-A-61-238056 wherein the development and the transfer are carried out at the same time or successively by heating in the presence of a small amount of a solvent (particularly water). In this system, the heating temperature is preferably 50° C. or more to at the most the boiling point of the solvent, and for example, in the case wherein the solvent is water, the heating temperature is 50° C. to 100° C.

Examples of the solvent that is used for acceleration of the development and/or for diffusion transfer of dyes include water, an aqueous basic solution containing an inorganic alkali metal salt or an organic base (as the base, those described in the section of image formation-accelerating agents can be used), a low-boiling solvent, and a mixed solution of a low-boiling solvent with water or the above-mentioned aqueous basic solution. Also, a surface-active agent, an antifoggant, a complex-forming compound with a hardly-soluble metal salt, a mildew-proofing agent, and an antifungus agent may be contained in the solvent.

As the solvent to be used in these heat development and diffusion transfer steps, water is preferably used, and the water may be any water that is generally used. Specifically, for example, distilled water, tap water, well water, and mineral water can be used. In the heat-development apparatus in which the heat-development light-sensitive material of the present invention and an dye-fixing material are used, water may be used only once, or it may be circulated for repeated use. In the latter case, water that contains components dissolved out of the material will be used. Also, apparatuses and water described, for example, in JP-A-63-144354, JP-A-63-144355, JP-A-62-38460, and JP-A-3-210555 may be used.

These solvents may be used in such a way that they are applied to the heat-development light-sensitive material or the dye-fixing material, or to both of them. The amount of the solvent to be used may be the weight of the solvent corresponding to or below the maximum swell volume of the entire coated film.

As the method of applying water, for example, methods described in JP-A-62-253159, page (5), JP-A-63-85544, and Japanese patent application No. 8-181045 are preferably used. Further, the solvent may be enclosed in microcapsules or may take the form of a hydrate, to be previously built into either or both of the heat-development light-sensitive material and dye-fixing material, for use.

The suitable temperature of the water to be applied is generally 30 to 60° C., as described, for example, in JP-A-63-85544, supra. It is particularly useful to make temperature 45° C. or more, in view of prevention of propagation of bacteria in water.

To accelerate the dye transfer, a system can be adopted wherein a hydrophilic heat solvent that is solid at normal temperatures and melts at a higher temperature is built in the heat-development light-sensitive material and/or the dye fixing material. The layer wherein the hydrophilic heat solvent is built in may be any of the light-sensitive silver halide emulsion layer, the intermediate layer, the protective layer, and the dye fixing layer, but preferably it is the dye fixing layer and/or the layer adjacent thereto.

Examples of the hydrophilic heat solvent include ureas, pyridines, amides, sulfonamides, imides, alcohols, oximes, and other heterocyclic compounds.

Example heating methods in the development step and/or transfer step include one wherein the photographic material is brought in contact with a heated block or plate; a method wherein the photographic material is brought in contact with a hot plate, a hot presser, a hot roller, a hot drum, a halogen lamp heater, an infrared lamp heater, or a far-infrared lamp heater; and a method wherein the photographic material is passed through a high-temperature atmosphere. As a method wherein the heat-development light-sensitive material and a dye-fixing material are placed one upon the other, methods described in JP-A-62-253159 and JP-A-61-147244, on page (27), can be applied.

To process the photographic elements for use in the present invention, any of various heat-development apparatuses can be used. For example, apparatuses described, for example, in JP-A-59-75247, JP-A-59-177547, JP-A-59-181353, and JP-A-60-18951, unexamined published Japanese Utility Model Application (JU-A) No. 62-25944, and JP-A-6-130509, JP-A-6-95338, and JP-A-6-95267 are preferably used. As a commercially available apparatus, for example, PICTROSTAT 100, PICTROSTAT 200, PICTROGRAPHY 3000, and PICTROGRAPHY 2000 (all trade names, manufactured by Fuji Photo Film Co., Ltd.), can be used.

In the case wherein the above image obtained by means of the heat-development light-sensitive material and the dye fixing element is used as a color proof for printing, the method for expressing the density may be any method of the continuous gradation control, the area gradation control that uses a part having discontinuous density, or the gradation control that is the combination of the above two.

By using an LD or LED as an exposure light source, the output of digital signal is made possible. Thus, the method for using (DDCP), wherein the control of the design and the image including the tinge or the like of printed products can be made on a CRT and a color proof is outputted as a final output, becomes possible. Namely, the DDCP serves as an effective means for caring out the output of a proof efficiently in the field of color proofs. This is because color printers are relatively simply constituted and inexpensive; in color printers, as is well known, the preparation of process films for color printers and the preparation of press plates (PS plates) or the like are not required; and hard copies each having an image on a sheet can be made easily, several times, in a short period of time.

When an LD or LED is used as an exposure light source, the three spectral sensitivities of yellow, magenta, and cyan, the four spectral sensitivities of yellow, magenta, cyan, and black, or the spectral sensitivities of respective colors obtained by mixing two or more coloring materials for the purpose of obtaining the desired hue, preferably have the peaks of the spectral sensitivities on separate wavelengths 20 nm or more apart respectively. Alternatively, there is a method wherein an image having two or more colors is obtained by using one exposure wavelength, when the spectral sensitivities of two or more colors are different in sensitivity from each other 10 times or more.

The heat-development color photographic light-sensitive material of the present invention exhibits an excellent action and effect that when it is processed for a short period of time, it exhibits an excellent color-forming property, and it forms an image low in the color impurity degree and excellent in color reproduction.

Next, the present invention is described in more detail based on the following Examples, but the invention is not limited to those.

EXAMPLES

Example 1

First, a method for preparing light-sensitive silver halide emulsions is described.

Light-Sensitive Silver Halide Emulsion (1) [for a red-sensitive emulsion layer]

To a well-stirred aqueous gelatin solution (prepared by adding 800 g of gelatin, 12 g of potassium bromide, 80 g of sodium chloride, and 1.2 g of Compound (a), to 26.3 liters of water, and keeping the temperature of the resulting solution at 53° C.), were added Solution (I) shown in Table 1 at a constant flow rate over 9 min, and Solution (II) at a constant flow rate over 9 min 10 sec starting before 10 sec of the addition of Solution (I). Further, after 6 min, Solution (III) shown in Table 1 was added at a constant flow rate over 24 min and Solution (IV) was added at a constant flow rate over 24 min 30 sec, in which the Solution (IV) was started to be added simultaneously with the start of addition of the Solution (III).

After washing with water and desalting (at a pH of 4.0 using Settling agent (a)) in a usual manner, 880 g of lime-processed ossein gelatin and 2.8 g of Compound (b) were added, the pH was adjusted to 6.0, and after the chemical sensitization was carried out optimally at 60° C. for 71 min by adding 12.8 g of a ribonucleic acid decomposition product and 32 mg of trimethylthiourea, 2.6 g of 4-hydroxy-6-methyl-1,3,3a,7-tetrazaindene, 3.2 g of Dye (a), 5.1 g of KBr, and 2,6 g of the later-described stabilizer were successively added, followed by cooling. In this way, 28.1 kg of a monodisperse cubic silver chlorobromide emulsion having an average grain size of 0.32 $\mu$m was obtained.

TABLE 1

| | Solution (I) | Solution (II) | Solution (III) | Solution (IV) |
|---|---|---|---|---|
| $AgNO_3$ | 1200 g | — | 2800 g | — |
| $NH_4NO_3$ | 2.5 g | — | 2.5 g | — |
| KBr | — | 546 g | — | 1766 g |
| NaCl | — | 144 g | — | 96 g |
| $K_2IrCl_6$ | — | 3.6 mg | — | — |
| | water to make 6.5 liters | water to make 6.5 liters | water to make 10 liters | water to make 10 liters |

Compound (a)

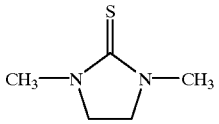

Compound (b)

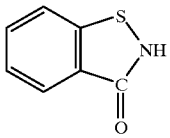

Dye (a)

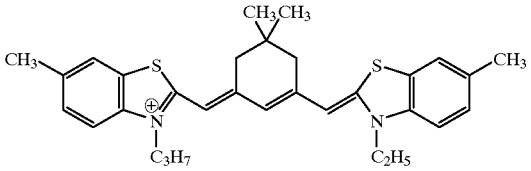

Settling agent (a)

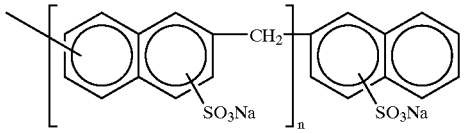

Light-Sensitive Silver Halide Emulsion (2) [for a green-sensitive emulsion layer]

To a well-stirred aqueous gelatin solution (prepared by adding 20 g of gelatin, 0.3 g of potassium bromide, 2 g of sodium chloride, and 30 mg of Compound (a), to 600 ml of water, and keeping the temperature of the resulting solution at 46° C.), were added Solutions (I) and (II) shown in Table 2 simultaneously at a constant flow rate over 9 min. After 5 min, Solutions (III) and (IV) shown in Table 2 were simultaneously added at a constant flow rate over 32 min. After 11 min of the start of the addition of the Solution (III), 100 cc of a 1% aqueous potassium iodide solution was added. One minute after the completion of the addition of Solutions (III) and (IV), 60 ml of a methanol solution of dyes (containing 360 mg of Dye (bl) and 73.4 mg of Dye (b2)) was added at a time.

After washing with water and desalting (at a pH of 4.0 using Settling agent (a)) in a usual manner, 22 g of lime-processed ossein gelatin was added, suitable amounts of NaCl and NaOH were added to adjust the pH and pAg to 6.0 and 7.6 respectively, and the chemical sensitization was carried out optimally at 60° C. by adding 0.18 g of a ribonucleic acid decomposition product, 4.2 mg of sodium thiosulfate, and 180 mg of 4-hydroxy-6-methyl-1,3,3a, 7-tetrazaindene, and after 90 mg of Antifogging agent (1) was added, the resultant mixture was cooled. Further, as antiseptic agents, 70 mg of Compound (b) and 3 ml of Compound (c) were added. In this way, 635 g of a monodisperse cubic silver chlorobromide emulsion having an average grain size of 0.30 $\mu$m was obtained.

TABLE 2

| | Solution (I) | Solution (II) | Solution (III) | Solution (IV) |
|---|---|---|---|---|
| $AgNO_3$ | 10.0 g | — | 90.0 g | — |
| $NH_4NO_3$ | 0.06 g | — | 0.38 g | — |
| KBr | — | 3.50 g | — | 57.1 g |
| NaCl | — | 1.72 g | — | 3.13 g |
| $K_2IrCl_6$ | — | — | — | 0.03 mg |
| | water to make 126 ml | water to make 131 ml | water to make 280 ml | water to make 289 ml |

Dye (b1)

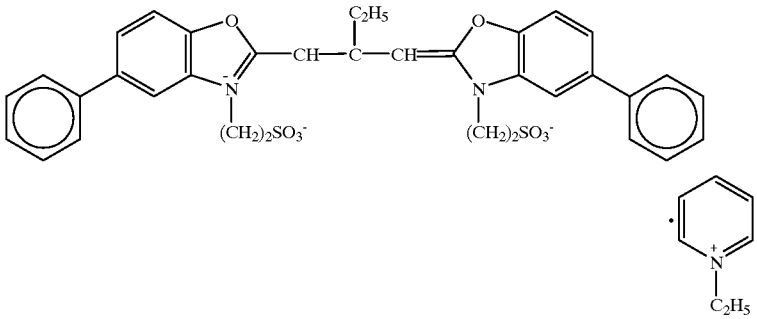

Dye (b2)

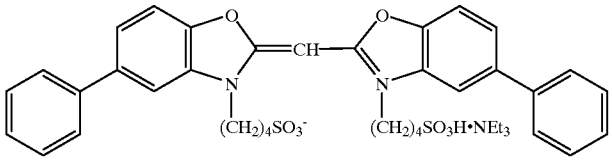

-continued

Antifoggant (1)

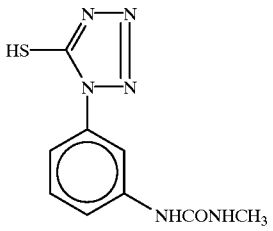

Light-sensitive silver Halide Emulsion (3) [for a blue-sensitive emulsion layer]

To a well-stirred aqueous gelatin solution (prepared by adding 1,582 g of gelatin, 127 g of KBr, and 660 mg of Compound (a), to 29.2 liters of water, and keeping the resultant solution at 72° C.), were added Solutions (I) and (II) having the compositions shown in Table 3, over 30 min, respectively, in which after 10 sec of the start of the addition of Solution (II), the Solution (I) was started to be added. Two minutes after the completion of the adding of Solution (I), Solution (V) was added; and after 5 min of the completion of the addition of Solution (II), Solution (IV) was started to be added, and after 10 sec thereof, Solution (III) was added, in which the Solution (III) was added over 27 min 50 sec and the Solution (IV) was added over 28 min.

Then, after washing with water and desalting (at a pH of 3.9 by using 32.4g of Settling agent (b)) in a usual manner, 1,230 g of lime-processed ossein gelatin and 2.8 mg of Compound (b) were added, and the pH and the pAg were adjusted to 6.1 and 8.4, respectively. Then, after the chemical sensitization was carried out optimally at 65° C. for about 70 min by adding 24.9 mg of sodium thiosulfate, 13.1 g of Dye (c) and 118 ml of Compound (c) were added successively, followed by cooling. The silver halide grains of the resulting emulsion were potato-like grains and had a grain size of 0.53 μm, and the yield was 30.7 kg.

TABLE 3

| | Solution (I) | Solution (II) | Solution (III) | Solution (IV) | Solution (V) |
|---|---|---|---|---|---|
| $AgNO_3$ | 939 g | — | 3461 g | — | — |
| $NH_4NO_3$ | 3.4 g | — | 15.4 g | — | — |
| KBr | — | 572 g | — | 2464 g | — |
| KI | — | | | — | 22.0 g |
| | water to make 6.69 liters | water to make 6.68 liters | water to make 9.70 liters | water to make 9.74 liters | water to make 4.40 liters |

Settling agent (b)

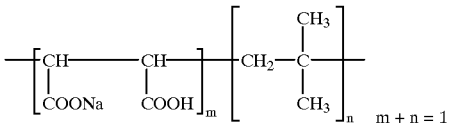

Compound (c)

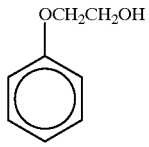

-continued

Dye (c)

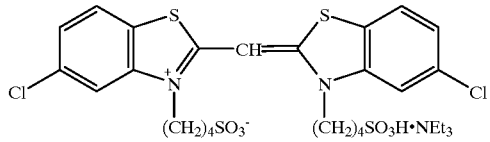

Next, a method for preparing a gelatin dispersion of Compound (d) is described.

0.76 g of Compound (d), 2.27 g of High-Boiling Organic Solvent (1), 0.23 g of Compound (f), 0.47 g of Compound (g), and 0.66 g of Surfactant (1) were weighed out, and 10 cc of ethyl acetate was added thereto, the resultant mixture was heated and dissolved at about 60° C. to make a uniform solution. After the solution and 62.5 g of a 16% solution of lime-processed gelatin were stirred and mixed, dispersing was carried out with a homogenizer for 10 min at 10,000 rpm. After dispersing, 28 cc of water for dilution was added. The resultant dispersion was named Dispersion of Compound (d).

Next, a method for preparing a gelatin dispersion of Compound (2) is described.

0.035 g of Compound (2), 0.017 g of Compound (0), 0.76 g of Compound (d), 2.27 g of High-Boiling Organic Solvent (1), 0.23 g of Compound (f), 0.47 g of Compound (g), 0.10 g of Compound (h), and 0.66 g of Surfactant (1) were weighed out, and 10 cc of ethyl acetate was added thereto, and the resultant mixture was heated and dissolved at about 60° C. to make a uniform solution. After the solution and 62.5 g of a 16% solution of lime-processed gelatin were stirred and mixed, dispersing was carried out with a homogenizer for 10 min at 10,000 rpm. After dispersing, 132 cc of water for dilution was added. The resultant dispersion was named Gelatin Dispersion of Compound (2) for use in the present invention.

Compound (d)

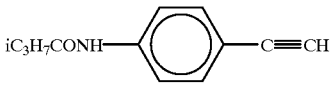

High-boiling organic solvent (1)

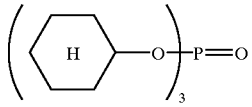

Compound (f)

$C_{26}H_{46.9}Cl_{7.1}$

Compound (g)

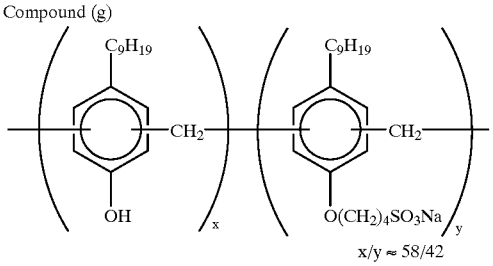

Surfactant (1)

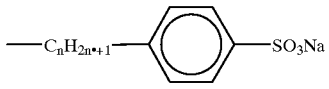

n ≈ 12.6

Compound (o)

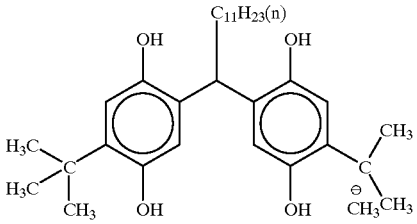

Compound (2)

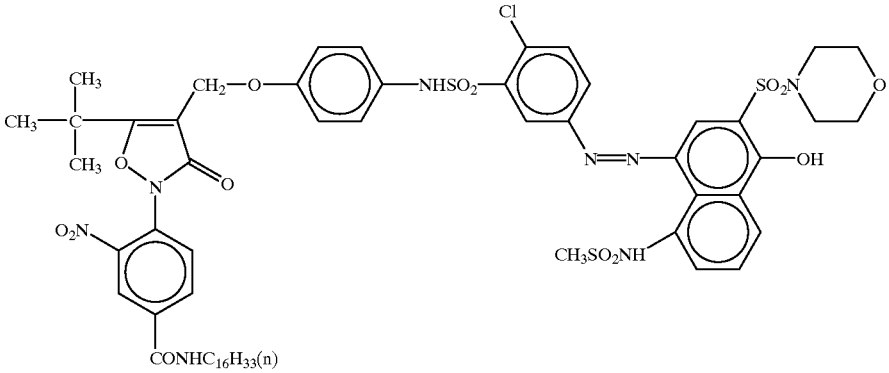

Compound (h)

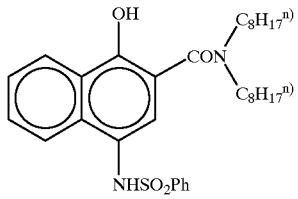

Next, a method for preparing a gelatin dispersion of a dye providing compound is described.

7.3 g of Cyan Dye Providing Compound (Al), 11.0 g of Cyan Dye Providing Compound (A2), 0.8 g of Surfactant (1), 1 g of Compound (h), 2.2 g of Compound (i), 7 g of High-Boiling Organic Solvent (1), and 3 g of High-Boiling Organic Solvent (2) were weighed out, and 26 ml of ethyl acetate and 1.2 ml of water were added thereto, and the resultant mixture was heated and dissolved at about 60° C. to make a uniform solution. After this solution, 65 g of a 16% solution of lime-processed gelatin, and 87 cc of water were stirred and mixed, dispersing was carried out with a homogenizer for 10 min at 10,000 rpm. After dispersing, 216 cc of water for dilution was added. The resultant dispersion was named Dispersion of cyan dye providing compounds.

Cyan-dye-providing compound (A1)

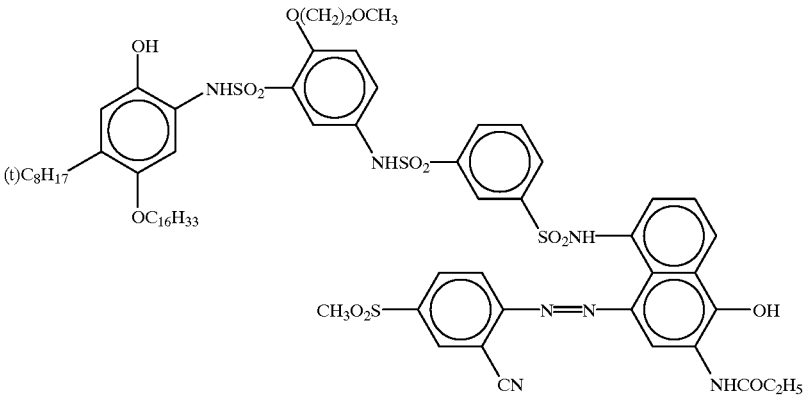

Cyan-dye-providing compound (A2)

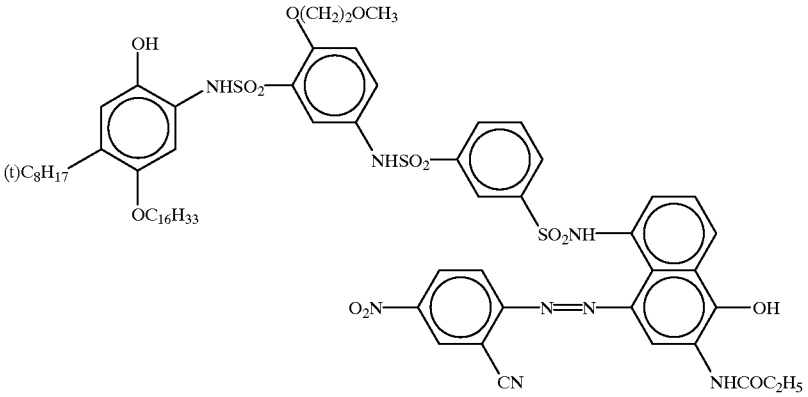

Compound (i)

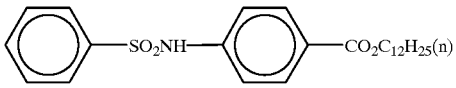

High-boiling solvent (2)

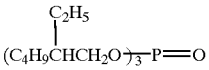

4.57 g of Magenta Dye Providing Compound (B), 0.051 g of Compound (m), 0.051 g of Compound (h), 0.032 g of Compound (n), 0.094 g of Surfactant (1), and 2.3 g of High-Boiling Organic Solvent (2) were weighed out, and 12 ml of ethyl acetate was added thereto, and the resultant mixture was heated and dissolved at about 60° C. to make a uniform solution. After this solution, 15.4 g of a 16% solution of lime-processed gelatin, and 23.7 cc of water were stirred and mixed, dispersing was carried out with a homogenizer for 10 min at 10,000 rpm. Thereafter, 43 cc of water for dilution was added. The resultant dispersion was named Dispersion of a magenta dye providing compound.

Magenta dye providing compound (B)

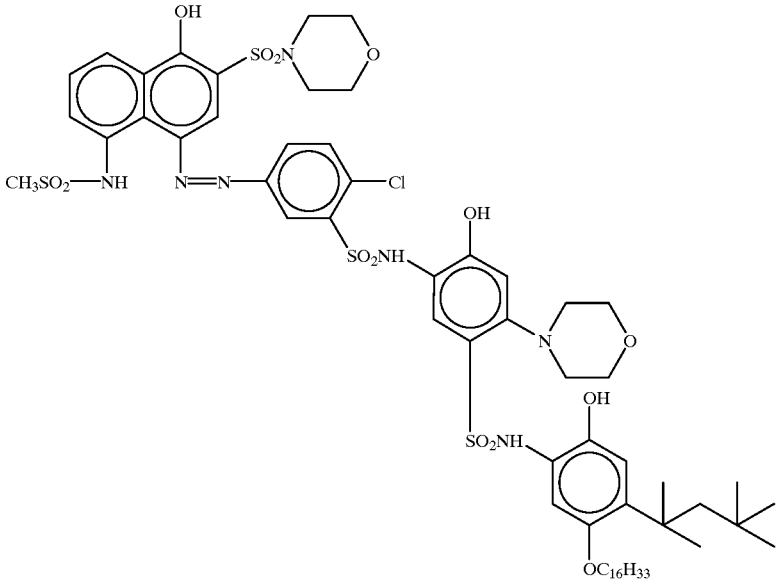

Compound (m)

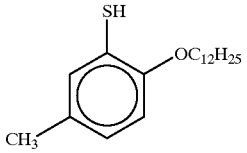

Compound (n)

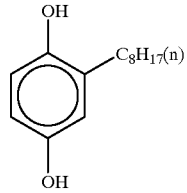

15 g of Yellow Dye Providing Compound (C), 2.3 g of Compound (d), 0.9 g of Compound (h), 0.88 g of Surfactant (1), 3.9 g of Compound (J), 1.9 g of Compound (K), and 16.9 g of High-Boiling Organic Solvent (1) were weighed out, and 49 ml of ethyl acetate was added thereto, and the resultant mixture was heated and dissolved at about 60° C. to make a uniform solution. After this solution, 63.5 g of a 16% solution of lime-processed gelatin, and 103 cc of water were stirred and mixed, dispersing was carried out with a homogenizer for 10 min at 10,000 rpm. Thereafter, 94 cc of water for dilution was added. The resultant dispersion was named Dispersion of a yellow dye providing compound.

Yellow dye providing compound(C)

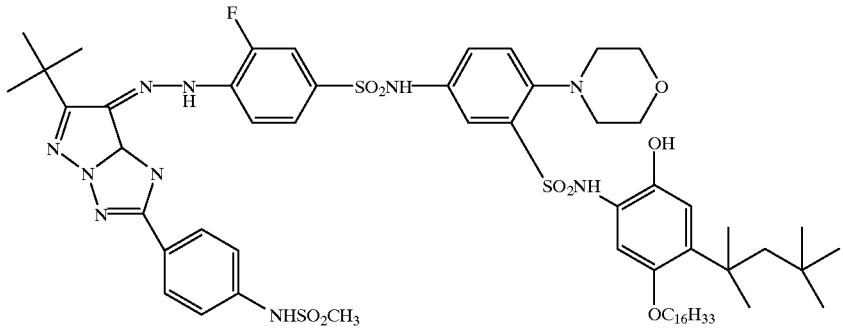

Compound (J)

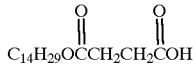

Compound (K)

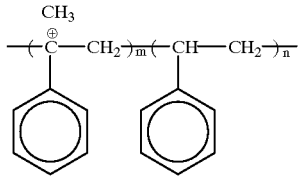

A gelatin dispersion of zinc hydroxide was prepared according to the formulation shown in Table 4. That is, after the components were mixed and dissolved, the resultant mixture was subjected to dispersing for 30 min in a mill, by using glass beads having an average particle diameter of 0.75 mm. Then the glass beads were separated and removed off, to obtain a uniform dispersion (the used zinc hydroxide had an average particle size of 0.25 $\mu$m).

TABLE 4

| | Composition of Dispersion |
|---|---|
| Zinc hydroxide | 15.9 g |
| Carboxymethyl cellulose | 0.7 g |
| Poly(sodium acrylate) | 0.07 g |
| Lime-processed gelatin | 4.2 g |
| Water | 100 ml |
| Compound (C) | 0.4 g |

By using the thus-prepared materials, Heat-Development Light-Sensitive Material 101, as shown in Table 5, was made.

TABLE 5

Constitution of light-sensitive material (Light-sensitive material 101)

| Layer No. | Layer name | Additive | Coated amount (g/m$^2$) |
|---|---|---|---|
| Seventh layer | Protective layer | Acid-processed gelatin | 0.408 |
| | | PMMA Matting agent | 0.017 |
| | | Surfactant (2) | 0.006 |
| | | Surfactant (3) | 0.017 |
| | | Dye trapping agent | 0.792 |
| Sixth layer | Inter-mediate layer | Gelatin | 0.746 |
| | | $Zn(OH)_2$ | 0.549 |
| | | Surfactant (3) | 0.002 |
| | | Compound (d) | 0.035 |
| | | Compound (f) | 0.011 |
| | | Compound (g) | 0.022 |
| | | High-boiling organic solvent (1) | 0.105 |
| | | $Ca(NO_3)_2$ | 0.019 |
| | | KBr | 0.006 |
| | | Surfactant (3) | 0.030 |
| | | Water-soluble polymer (1) | 0.003 |
| Fifth layer | Blue-sensitive layer | Silver halide emulsion (3) | in terms of silver 0.392 |
| | | Gelatin | 0.523 |
| | | Yellow dye providing compound (C) | 0.342 |
| | | Compound (d) | 0.053 |
| | | Compound (h) | 0.021 |
| | | Compound (j) | 0.090 |
| | | Compound (k) | 0.044 |
| | | High-boiling organic solvent (1) | 0.384 |
| | | Surfactant (1) | 0.028 |
| | | Water-soluble polymer (1) | 0.007 |
| Fourth layer | Inter-mediate layer | Gelatin | 0.457 |
| | | $Zn(OH)_2$ | 0.349 |
| | | Surfactant (3) | 0.001 |
| | | Compound (d) | 0.021 |
| | | Compound (f) | 0.006 |
| | | Compound (g) | 0.013 |
| | | High-boiling organic solvent (1) | 0.064 |
| | | $Ca(NO_3)_2$ | 0.011 |
| | | KBr | 0.004 |
| | | Surfactant (1) | 0.019 |
| | | Water-soluble polymer (1) | 0.002 |
| Third layer | Green-sensitive layer | Silver halide emulsion (2) | in terms of silver 0.237 |
| | | Gelatin | 0.403 |
| | | Magenta dye providing compound (B) | 0.361 |

TABLE 5-continued

Constitution of light-sensitive material (Light-sensitive material 101)

| | | | |
|---|---|---|---|
| | | Compound (m) | 0.004 |
| | | Compound (h) | 0.004 |
| | | Compound (n) | 0.003 |
| | | High-boiling organic solvent (2) | 0.180 |
| | | Surfactant (1) | 0.011 |
| | | Water-soluble polymer (1) | 0.007 |
| Second layer | Inter-mediate layer | Gelatin | in terms of silver 0.503 |
| | | Surfactant (4) | 0.067 |
| | | Surfactant (3) | 0.006 |
| | | Compound (d) | 0.022 |
| | | Compound (f) | 0.007 |
| | | Compound (g) | 0.013 |
| | | Compound (2) | 0.0010 |
| | | Compound (0) | 0.0005 |
| | | Surfactant (1) | 0.019 |
| | | High-boiling organic solvent (1) | 0.065 |
| | | $Ca(NO_3)_2$ | 0.012 |
| | | Water-soluble polymer (1) | 0.019 |
| First layer | Red-sensitive layer | Silver halide emulsion (1) | in terms of silver 0.142 |
| | | Gelatin | 0.324 |
| | | Cyan dye providing compound (A1) | 0.111 |
| | | Cyan dye providing compound (A2) | 0.167 |
| | | Compound (i) | 0.033 |
| | | Compound (h) | 0.016 |
| | | High-boiling organic solvent (1) | 0.047 |
| | | High-boiling organic solvent (2) | 0.109 |
| | | Surfactant (1) | 0.017 |
| | | Water-soluble polymer (1) | 0.013 |
| | | Stabilizer | 0.004 |
| | | Hardener | 0.035 |

Base (1) polyethylene-laminated paper base (thickness 131 $\mu$m)

Base (1)

| Name of layer | Composition | Film thickness ($\mu$m) |
|---|---|---|
| Surface undercoat layer | Gelatin | 0.1 |
| Surface PE layer (Glossy) | Low-density polyethylene (Density 0.923): 89.2 parts<br>Surface-processed titanium oxide: 10.0 parts<br>Ultramarine: 0.8 parts | 36.0 |
| Pulp layer | Fine quality paper (LBKP/NBKP = 1/1, Density 1.080) | 64.0 |
| Back-surface PE layer (Matte) | High-density polyethylene (Density 0.960) | 31.0 |
| Back-surface undercoat layer | Gelatin | 0.05 |
| | Colloidal silica | 0.05 |
| | | 131.2 |

Surfactant(2)

$$C_8F_{17}SO_2\underset{\underset{C_3H_7}{|}}{N}CH_2CH_2O(CH_2CH_2O)_nH \qquad n = 15$$

-continued

Surfactant(3)

Aerosol OT

Surfactant(4)

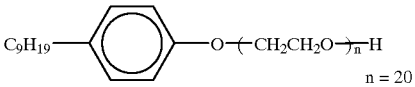

n = 20

Water-soluble polymer(1)

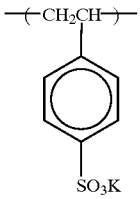

Hardener(1)

$CH_2{=}CHSO_2CH_2SO_2CH{=}CH_2$

-continued

Stabilizer

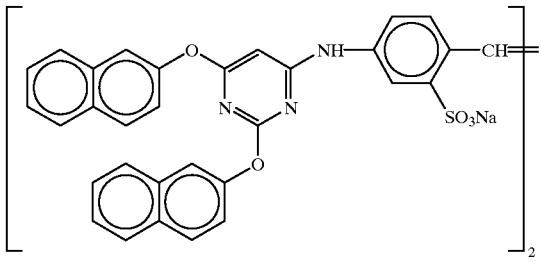

Then, to the first layer, the third layer, and the fifth layer of the thus-obtained Sample 101, was added a compound represented by formula (1) or (2) for use in the present invention, as shown in Table 6, alternatively an electron transport agent for comparison was prepared as shown below and was added in the same manner, to prepare Samples 101 to 104.

Further, a compound capable of reacting with the oxidized product of the electron transport agent was added, as shown in Table 6, to prepare Samples 105 to 116.

In this connection, the compound capable of reacting with the oxidized product of an electron transport agent was used by adding it to Dispersion of (D).

TABLE 6

| | Compound of formula (1) or (2) | | | Compound capable of reacting with the oxidized product of the electron transport agent | | | |
|---|---|---|---|---|---|---|---|
| Sample No. | Compound | Amount to be used (mol % to the dye providing compounds in each layer) | Added layer | Compound | Amount to be used per layer (mmol/m$^2$) | Added layer | Remarks |
| 101 | none | — | — | — | — | — | Comparative Example |
| 102 | D-2 | 0.2 | First layer, Third layer, Fifth layer | — | — | — | Comparative Example |
| 103 | D-20 | " | First layer, Third layer, Fifth layer | — | — | — | Comparative Example |
| 104 | Electron transport agent for comparison | 0.05 | First layer, Third layer, Fifth layer | — | — | — | Comparative Example |
| 105 | D-2 | 0.2 | First layer, Third layer, Fifth layer | A-6 | 0.25 | Second layer, Fourth layer | This invention |
| 106 | D-20 | " | First layer, Third layer, Fifth layer | " | " | Second layer, Fourth layer | This invention |
| 107 | Electron transport agent for comparison | 0.05 | First layer, Third layer, | " | " | Second layer, Fourth layer | Comparative example |

TABLE 6-continued

| Sample No. | Compound of formula (1) or (2) Compound | Amount to be used (mol % to the dye providing compounds in each layer) | Added layer | Compound capable of reacting with the oxidized product of the electron transport agent Com-pound | Amount to be used per layer (mmol/m$^2$) | Added layer | Remarks |
|---|---|---|---|---|---|---|---|
| | | | Fifth layer | | | | |
| 108 | D-2 | 0.2 | 1st, 3rd and 5th layers | A-16 | 0.25 | 2nd and 4th layers | This invention |
| 109 | D-20 | " | 1st, 3rd and 5th layers | A-16 | " | 2nd and 4th layers | This invention |
| 110 | Electron transport agent for comparison | 0.05 | 1st, 3rd and 5th layers | " | " | 2nd and 4th layers | Comparative example |
| 111 | D-2 | 0.2 | 1st, 3rd and 5th layers | A-21 | " | 2nd and 4th layers | This invention |
| 112 | D-20 | " | 1st, 3rd and 5th layers | " | " | 2nd and 4th layers | This invention |
| 113 | Electron transport agent for comparison | 0.05 | 1st, 3rd and 5th layers | " | " | 2nd and 4th layers | Comparative example |
| 114 | D-2 | 0.2 | 1st, 3rd and 5th layers | C-17 | " | 2nd and 4th layers | This invention |
| 115 | D-20 | " | 1st, 3rd and 5th layers | " | " | 2nd and 4th layers | This invention |
| 116 | Electron transport agent for comparison | 0.05 | 1st, 3rd and 5th layers | " | " | 2nd and 4th layers | Comparative example |

A method for preparing a dispersion of an electron transport agent for comparison is described.

10 g of the below-shown electron transport agent for comparison, 0.5 g of a polyethylene glycol nonyl phenyl ether as a dispersant, and 0.5 g of the below-shown anionic surfactant were added to a 5% aqueous gelatin solution, and grinding of the resultant mixture was carried out for 60 min in a mill by using glass beads having an average particle diameter of 0.75 mm. The glass beads were separated, to obtain a dispersion of the electron transport agent for comparison having an average particle diameter of 0.35 $\mu$m.

Electron transport agent for comparison

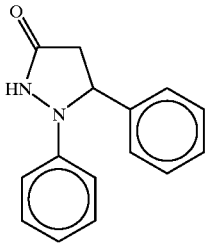

Anionic surface-active agent

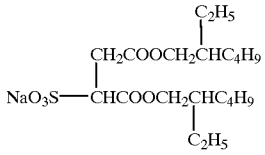

These samples were respectively subjected to separation exposure of RGB, imagewise, and they were subjected to heat-development with Paper PS3-SG for PICTROSTAT 330 (both trade names), manufactured by Fuji Photo Film Co., Ltd. The processing was carried out by using PICTROSTAT 330, trade name, manufactured by Fuji Photo Film Co., Ltd., under conditions of 83° C. for 15 sec. The above processing conditions are processing conditions wherein the period is shorter than that of the conventional processing conditions (83° C. for 25 sec).

The thus-obtained processed samples were measured by an autographic recording-type densitometer, to find the maximum color densities of yellow, magenta, and cyan; and color impurity degree for respective color was found by the below-shown methods, and the color impurity degree found was shown in terms of relative value by assuming the value of Sample 101 to be 100. The smaller the value of the color impurity degree is, the higher the chromaticness (colorfulness) is, meaning that the light-sensitive material is excellent in color reproduction.

(Color Impurity Degree)

(A) Color Impurity Degree of Yellow

This is the magenta density at the exposure amount, wherein the yellow density becomes 1 at the time of B separation exposure.

(B) Color Impurity Degree of Magenta

This is the cyan density at the exposure amount, wherein the magenta density becomes 1 at the time of G separation exposure.

(C) Color Impurity Degree of Cyan

This is the magenta density at the exposure amount, wherein the cyan density becomes 1 at the time of R separation exposure.

The results are shown in Table 7.

It has been found that even in processing for a shorter period of time, the light-sensitive material of the present invention, wherein use was made of an electron transport agent represented by formula (1) or (2) and a compound capable of reacting with the oxidized product of the electron transport agent, exhibited excellent color forming property, and it was excellent in color reproduction without deterioration for the color impurity degree.

TABLE 7

| | | | Yellow | | Magenta | | Cyan | | |
|---|---|---|---|---|---|---|---|---|---|
| Sample No. | Compound added (Emulsion layer) | Compound added (Inter-layer) | Maximum color density | Color impurity degree (A) | Maximum color density | Color impurity degree (B) | Maximum color density | Color impurity degree (C) | Remarks |
| 101 | none | — | 100 | 100 | 100 | 100 | 100 | 100 | Comparative example |
| 102 | D-2 | — | 148 | 215 | 149 | 169 | 146 | 140 | Compartive example |
| 103 | D-20 | — | 150 | 220 | 150 | 160 | 149 | 139 | Comparative example |
| 104 | Electron transport agent for comparison | — | 151 | 255 | 150 | 194 | 150 | 179 | Comparative example |
| 105 | D-2 | A-6 | 142 | 102 | 144 | 99 | 143 | 95 | This invention |
| 106 | D-20 | " | 144 | 95 | 145 | 95 | 143 | 99 | This invention |
| 107 | Electron transport agent for comparison | " | 148 | 186 | 147 | 145 | 149 | 140 | Comparative example |
| 108 | D-2 | A-16 | 140 | 89 | 141 | 89 | 142 | 90 | This invention |
| 109 | D-20 | " | 141 | 90 | 142 | 88 | 145 | 93 | This invention |
| 110 | Electron transport agent for comparison | " | 145 | 156 | 144 | 151 | 149 | 148 | Comparative example |
| 111 | D-2 | A-21 | 146 | 88 | 146 | 82 | 147 | 92 | This invention |

TABLE 7-continued

| Sample No. | Compound added (Emulsion layer) | Compound added (Inter-layer) | Yellow Maximum color density | Yellow Color impurity degree (A) | Magenta Maximum color density | Magenta Color impurity degree (B) | Cyan Maximum color density | Cyan Color impurity degree (C) | Remarks |
|---|---|---|---|---|---|---|---|---|---|
| 112 | D-20 | " | 147 | 85 | 148 | 85 | 148 | 91 | This invention |
| 113 | Electron transport agent for comparison | " | 150 | 148 | 150 | 145 | 149 | 150 | Comparative example |
| 114 | D-2 | C-17 | 146 | 89 | 146 | 90 | 147 | 95 | This invention |
| 115 | D-20 | " | 148 | 92 | 147 | 87 | 148 | 96 | This invention |
| 116 | Electron transport agent for comparison | " | 152 | 240 | 150 | 188 | 150 | 172 | Comparative example |

Example 2

Light-Sensitive Material 101, as described in Example 1 of JP-A-10-142764, was prepared. This was named Light-Sensitive Material 201.

To the thus-obtained Light-Sensitive Material 201, were added an electron transport agent represented by formula (1) or (2) and a compound capable of reacting with the oxidized product of the electron transport agent, according to the present invention, as shown in Table 8, to prepare Samples 202 to 216.

TABLE 8

| Sample No. | Compound of formula (1) or (2): Compound | Amount to be used (mol% to coupler in each layer) | Added layer | Compound capable of reacting with the oxidized product of the electron transport agent: Compound | Amount to be used per layer (mmol/m$^2$) | Added layer | Remarks |
|---|---|---|---|---|---|---|---|
| 201 | none | — | — | — | — | — | Comparative Example |
| 202 | D-2 | 0.10 | First layer, Third layer Fifth layer | — | — | — | Comparative Example |
| 203 | D-6 | " | First layer, Third layer Fifth layer | — | — | — | Comparative Example |
| 204 | D-20 | 0.20 | First layer, Third layer Fifth layer | — | — | — | Comparative Example |
| 205 | D-2 | 0.10 | First layer, Third layer Fifth layer | A-6 | 0.30 | Second layer, Fourth layer | This invention |
| 206 | D-6 | " | First layer, Third layer Fifth layer | " | " | Second layer, Fourth layer | This invention |

TABLE 8-continued

| Sample No. | Compound of formula (1) or (2) Compound | Amount to be used (mol% to coupler in each layer) | Added layer | Compound capable of reacting with the oxidized product of the electron transport agent Compound | Amount to be used per layer (mmol/m$^2$) | Added layer | Remarks |
|---|---|---|---|---|---|---|---|
| 207 | D-20 | 0.20 | First layer, Third layer Fifth layer | " | " | Second layer, Fourth layer | This invention |
| 208 | D-2 | 0.10 | First layer, Third layer Fifth layer | A-16 | " | Second layer, Fourth layer | This invention |
| 209 | D-6 | " | First layer, Third layer Fifth layer | " | " | Second layer, Fourth layer | This invention |
| 210 | D-20 | 0.20 | First layer, Third layer Fifth layer | " | " | Second layer, Fourth layer | This invention |
| 211 | D-2 | 0.10 | First layer, Third layer Fifth layer | A-21 | " | Second layer, Fourth layer | This invention |
| 212 | D-6 | " | First layer, Third layer Fifth layer | " | " | Second layer, Fourth layer | This invention |
| 213 | D-20 | 0.20 | First layer, Third layer Fifth layer | " | " | Second layer, Fourth layer | This invention |
| 214 | D-2 | 0.10 | First layer, Third layer Fifth layer | C-17 | " | Second layer, Fourth layer | This invention |
| 215 | D-6 | " | First layer, Third layer Fifth layer | " | " | Second layer, Fourth layer | This invention |
| 216 | D-20 | 0.20 | First layer, Third layer Fifth layer | " | " | Second layer, Fourth layer | This invention |

The thus-obtained Light-Sensitive Materials 201 to 216 were subjected to exposure and development in the same manner as in Example 1, except that the developing temperature and the developing time were changed to 83° C. and 15 sec, respectively, and then in the same manner as in Example 1, the maximum color densities and the color impurity degrees of yellow, magenta, and cyan were evaluated. The results are shown in Table 9.

It has been found that even in processing for a shorter period of time, the light-sensitive material of the present invention, wherein use was made of an electron transport agent represented by formula (1) or (2) and a compound capable of reacting with the oxidized product of the electron transport agent, exhibited excellent color forming property and it was excellent in color reproduction without deterioration for the color impurity degree.

TABLE 9

| Sample No. | Compound added (Emulsion layer) | Compound added (Inter-layer) | Yellow Maximum color density | Yellow Color impurity degree (A) | Magenta Maximum color density | Magenta Color impurity degree (B) | Cyan Maximum color density | Cyan Color impurity degree (C) | Remarks |
|---|---|---|---|---|---|---|---|---|---|
| 201 | none | — | 100 | 100 | 100 | 100 | 100 | 100 | Comparative example |
| 202 | D-2 | — | 165 | 189 | 160 | 170 | 155 | 170 | Comparative example |
| 203 | D-6 | — | 171 | 180 | 162 | 174 | 159 | 169 | Comparative example |
| 204 | D-20 | — | 170 | 175 | 159 | 174 | 156 | 179 | Comparative example |
| 205 | D-2 | A-6 | 169 | 90 | 166 | 92 | 159 | 95 | This invention |
| 206 | D-6 | " | 172 | 90 | 163 | 88 | 160 | 95 | This invention |
| 207 | D-20 | " | 175 | 92 | 164 | 91 | 167 | 89 | This invention |
| 208 | D-2 | A-16 | 178 | 91 | 159 | 90 | 166 | 91 | This invention |
| 209 | D-6 | " | 178 | 88 | 164 | 90 | 161 | 92 | This invention |
| 210 | D-20 | " | 145 | 89 | 166 | 87 | 165 | 88 | This invention |
| 211 | D-2 | A-21 | 180 | 89 | 162 | 89 | 163 | 92 | This invention |
| 212 | D-6 | " | 182 | 87 | 161 | 91 | 162 | 91 | This invention |
| 213 | D-20 | " | 181 | 90 | 167 | 91 | 166 | 92 | This invention |
| 214 | D-2 | C-17 | 185 | 91 | 163 | 92 | 170 | 98 | This invention |
| 215 | D-6 | " | 190 | 90 | 161 | 90 | 169 | 96 | This invention |
| 216 | D-20 | " | 186 | 89 | 166 | 93 | 168 | 98 | This invention |

Having described our invention as related to the present embodiments, it is our intention that the invention not be limited by any of the details of the description, unless otherwise specified, but rather be construed broadly within its spirit and scope as set out in the accompanying claims.

What I claim is:

1. A heat-development color photographic light-sensitive material having on a base at least two applied silver halide emulsion layers different in color sensitivity from each other and at least one applied non-light-sensitive layer, wherein the silver halide emulsion layer or the non-light-sensitive layer contains a dye providing compound and at least one diffusible electron transport agent represented by formula (1) or (2):

formula (1)

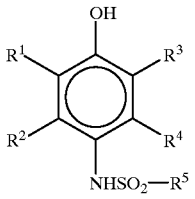

-continued formula (2)

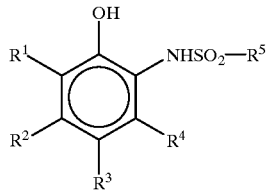

wherein $R^1$, $R^2$, $R^3$, and $R^4$ each represent a hydrogen atom, a halogen atom, a cyano group, or an alkyl group, an aryl group, a heterocyclic group, an alkoxy group, an aryloxy group, an alkylthio group, an arylthio group, an alkylcarbonyl group, an arylcarbonyl group, an alkylsulfonyl group, an arylsulfonyl group, an alkylcarbonamido group, an arylcarbonamido group, an alkylsulfonamido group, an arylsulfonamido group, an alkylcarbonyloxy group, an arylcarbonyloxy group, a carbamoyl group, an alkylcarbamoyl group, an arylcarbamoyl group, an alkoxycarbonyl group, an aryloxycarbonyl group, a sulfamoyl group, an alkylsulfamoyl group, an arylsulfamoyl group, a ureido group, or a urethane group that respectively has 4 or less carbon atoms or an I/O value of 1 or more, and $R^5$ represents an alkyl group, an aryl group, a heterocyclic group, an alkylamino group, an arylamino group, or a heterocyclic amino group, and wherein the non-light-sensitive layer contains a compound capable of reacting with an oxidized product of the electron transport agent.

2. The heat-development color photographic light-sensitive material as claimed in claim 1, wherein, in formulas (1) and (2), $R^5$ is an aryl group represented by the following formula (3):

formula (3)

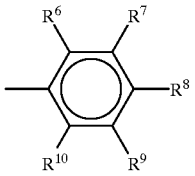

wherein $R^6$, $R^7$, $R^8$, $R^9$, and $R^{10}$ each represent a hydrogen atom, a halogen atom, a cyano group, a nitro group, or an alkyl group, a heterocyclic group, an alkoxy group, an aryloxy group, an alkylthio group, an arylthio group, an alkylcarbonyl group, an arylcarbonyl group, an alkylsulfonyl group, an arylsulfonyl group, an alkylcarbonamido group, an arylcarbonamido group, an alkylsulfonamido group, an arylsulfonamido group, an alkylcarbonyloxy group, an arylcarbonyloxy group, a carbamoyl group, an alkylcarbamoyl group, an arylcarbamoyl group, an alkoxycarbonyl group, an aryloxycarbonyl group, a sulfamoyl group, an alkylsulfamoyl group, an arylsulfamoyl group, a ureido group, or a urethane group that respectively has 4 or less carbon atoms or an I/O value of 1 or more; and $R^6$ and $R^7$, $R^7$ and $R^8$, $R^8$ and $R^9$, and $R^9$ and $R^{10}$ each may independently form a ring.

3. The heat-development color photographic light-sensitive material as claimed in claim 1, wherein, in formula (1), $R^2$ and/or $R^4$ each represent a substituent other than a hydrogen atom, and in formula (2), $R^4$ represents a substituent other than a hydrogen atom.

4. The heat-development color photographic light-sensitive material as claimed in claim 1, wherein the at least one diffusible electron transport agent is a compound represented by the formula (1).

5. The heat-development color photographic light-sensitive material as claimed in claim 1, wherein the compound capable of reacting with the oxidized product of the electron transport agent is a compound represented by the following formula (A):

formula (A)

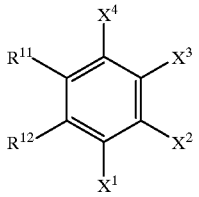

wherein $R^{11}$ and $R^{12}$ each represent a hydrogen atom, a halogen atom, a carboxyl group or a sulfo group that may be in the form of a salt, or a substituted or unsubstituted alkyl group, aryl group, acylamino group, alkoxy group, aryloxy group, alkylthio group, arylthio group, carbamoylamino group, alkoxycarbonylamino group, aryloxycarbonylamino group, carbamoyl group, acyl group, alkoxycarbonyl group, aryloxycarbonyl group, sulfamoyl group, or sulfonyl group, one of $X^1$, $X^2$, $X^3$, and $X^4$ represents a hydroxyl group, at least one of the rest thereof represents a hydroxyl group, a sulfonamido group, or a carbonamido group, and others of the rest thereof each represent one of the above-mentioned atoms or groups represented by $R^{11}$ and $R^{12}$, and the total number of carbon atoms of $R^{11}$, $R^{12}$, $X^1$, $X^2$, $X^3$, and $X^4$ is 10 or more.

6. The heat-development color photographic light-sensitive material as claimed in claim 5, wherein the compound represented by the formula (A) is a compound represented by the following formula (B):

formula (B)

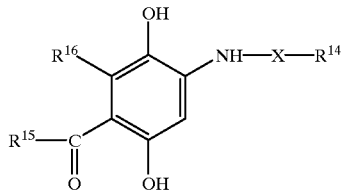

wherein, X represents —CO— or —$SO_2$—, $R^{14}$ and $R^{15}$ each represent an alkyl group, an aryl group, or a heterocyclic group, $R^{16}$ represents a hydrogen atom, a halogen atom, an aryl group, an acylamino group, an alkoxy group, an aryloxy group, an alkylthio group, an arylthio group, an acyl group, a sulfonyl group, a carbamoyl group, or a sulfamoyl group, $R^{15}$ and $R^{16}$ may together form a carbon ring or a heterocyclic ring, and a dimer or a trimer may be formed through $R^{14}$ or $R^{15}$.

7. The heat-development color photographic light-sensitive material as claimed in claim 1, wherein the compound capable of reacting with the oxidized product of the electron transport agent is a coupler capable of forming a non-diffusion dye, or a non-dye-forming coupler.

8. The heat-development color photographic light-sensitive material as claimed in claim 1, wherein the compound capable of reacting with the oxidized product of the electron transport agent is a non-diffusion compound.

9. The heat-development color photographic light-sensitive material as claimed in claim 1, wherein the silver halide emulsion layer contains the dye providing compound and the at least one diffusible electron transport agent represented by formula (1) or (2), and the non-light-sensitive layer that is an intermediate layer and is adjacent to the emulsion layer contains the compound capable of reacting with the oxidized product of the electron transport agent.

10. An image-forming method, comprising subjecting a silver halide color photographic light-sensitive material to image-wise exposure and then to heat development, to release or form a diffusion dye imagewise, and transferring the diffusion dye to a dye fixing element, wherein the silver halide color photographic light-sensitive material is a heat-development color photographic light-sensitive material which has on a base at least two applied silver halide emulsion layers different in color sensitivity from each other and at least one applied non-light-sensitive layer, wherein the silver halide emulsion layer or the non-light-sensitive layer contains a dye providing compound and at least one diffusible electron transport agent represented by formula (1) or (2):

formula (1)

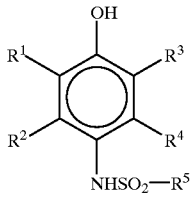

formula (2)

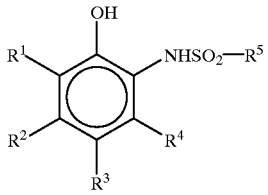

wherein $R^1$, $R^2$, $R^3$, and $R^4$ each represent a hydrogen atom, a halogen atom, a cyano group, or an alkyl group, an aryl group, a heterocyclic group, an alkoxy group, an aryloxy group, an alkylthio group, an arylthio group, an alkylcarbonyl group, an arylcarbonyl group, an alkylsulfonyl group, an arylsulfonyl group, an alkylcarbonamido group, an arylcarbonamido group, an alkylsulfonamido group, an arylsulfonamido group, an alkylcarbonyloxy group, an arylcarbonyloxy group, a carbamoyl group, an alkylcarbamoyl group, an arylcarbamoyl group, an alkoxycarbonyl group, an aryloxycarbonyl group, a sulfamoyl group, an alkylsulfamoyl group, an arylsulfamoyl group, a ureido group, or a urethane group that respectively has 4 or less carbon atoms or an I/O value of 1 or more, and $R^5$ represents an alkyl group, an aryl group, a heterocyclic group, an alkylamino group, an arylamino group, or a heterocyclic amino group, and wherein the non-light-sensitive layer contains a compound capable of reacting with an oxidized product of the electron transport agent.

11. The image-forming method as claimed in claim 10, wherein, in formulas (1) and (2), $R^5$ is an aryl group represented by the following formula (3):

formula (3)

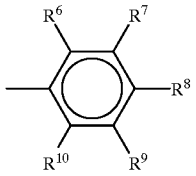

wherein $R^6$, $R^7$, $R^8$, $R^9$, and $R^{10}$ each represent a hydrogen atom, a halogen atom, a cyano group, a nitro group, or an alkyl group, a heterocyclic group, an alkoxy group, an aryloxy group, an alkylthio group, an arylthio group, an alkylcarbonyl group, an arylcarbonyl group, an alkylsulfonyl group, an arylsulfonyl group, an alkylcarbonamido group, an arylcarbonamido group, an alkylsulfonamido group, an arylsulfonamido group, an alkylcarbonyloxy group, an arylcarbonyloxy group, a carbamoyl group, an alkylcarbamoyl group, an arylcarbamoyl group, an alkoxycarbonyl group, an aryloxycarbonyl group, a sulfamoyl group, an alkylsulfamoyl group, an arylsulfamoyl group, a ureido group, or a urethane group that respectively has 4 or less carbon atoms or an I/O value of 1 or more; and $R^6$ and $R^7$, $R^7$ and $R^8$, $R^8$ and $R^9$, and $R^9$ and $R^{10}$ each may independently form a ring.

12. The image-forming method as claimed in claim 10, wherein, in formula (1), $R^2$ and/or $R^4$ each represent a substituent other than a hydrogen atom, and in formula (2), $R^4$ represents a substituent other than a hydrogen atom.

13. The image-forming method as claimed in claim 10, wherein the at least one diffusible electron transport agent is a compound represented by the formula (1).

14. The image-forming method as claimed in claim 10, wherein the compound capable of reacting with the oxidized product of the electron transport agent is a compound represented by the following formula (A):

formula (A)

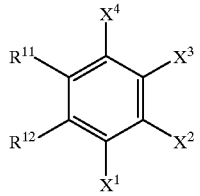

wherein $R^{11}$ and $R^{12}$ each represent a hydrogen atom, a halogen atom, a carboxyl group or a sulfo group that may be in the form of a salt, or a substituted or unsubstituted alkyl group, aryl group, acylamino group, alkoxy group, aryloxy group, alkylthio group, arylthio group, carbamoylamino group, alkoxycarbonylamino group, aryloxycarbonylamino group, carbamoyl group, acyl group, alkoxycarbonyl group, aryloxycarbonyl group, sulfamoyl group, or sulfonyl group, one of $X^1$, $X^2$, $X^3$, and $X^4$ represents a hydroxyl group, at least one of the rest thereof represents a hydroxyl group, a sulfonamido group, or a carbonamido group, and others of the rest thereof each represent one of the above-mentioned atoms or groups represented by $R^{11}$ and $R^{12}$, and the total number of carbon atoms of $R^{11}$, $R^{12}$, $X^1$, $X^2$, $X^3$, and $X^4$ is 10 or more.

15. The image-forming method as claimed in claim 14, wherein the compound represented by the formula (A) is a compound represented by the following formula (B):

formula (B)

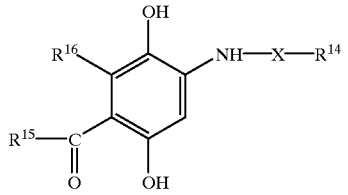

wherein, X represents —CO— or —$SO_2$—, $R^{14}$ and $R^{15}$ each represent an alkyl group, an aryl group, or a heterocyclic group, $R^{16}$ represents a hydrogen atom, a halogen atom, an aryl group, an acylamino group, an alkoxy group, an aryloxy group, an alkylthio group, an arylthio group, an acyl group, a sulfonyl group, a carbamoyl group, or a sulfamoyl group, $R^{15}$ and $R^{16}$ may together form a carbon ring or a heterocyclic ring, and a dimer or a trimer may be formed through $R^{14}$ or $R^{15}$.

16. The image-forming method as claimed in claim 10, wherein the compound capable of reacting with the oxidized product of the electron transport agent is a coupler capable of forming a non-diffusion dye, or a non-dye-forming coupler.

17. The image-forming method as claimed in claim 10, wherein the compound capable of reacting with the oxidized product of the electron transport agent is a non-diffusion compound.

18. The image-forming method as claimed in claim 10, wherein the silver halide emulsion layer contains the dye providing compound and the at least one diffusible electron transport agent represented by formula (1) or (2), and the non-light-sensitive layer that is an intermediate layer and is adjacent to the emulsion layer contains the compound capable of reacting with the oxidized product of the electron transport agent.

* * * * *